US011137713B2

(12) United States Patent
Sekiyama

(10) Patent No.: US 11,137,713 B2
(45) Date of Patent: Oct. 5, 2021

(54) IMAGE FORMING APPARATUS

(71) Applicant: CANON KABUSHIKI KAISHA, Tokyo (JP)

(72) Inventor: Junichi Sekiyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/909,771

(22) Filed: Jun. 23, 2020

(65) Prior Publication Data

US 2020/0409303 A1 Dec. 31, 2020

(30) Foreign Application Priority Data

Jun. 27, 2019 (JP) ..... JP2019-120452

(51) Int. Cl.
*G03G 21/16* (2006.01)

(52) U.S. Cl.
CPC ..... *G03G 21/1633* (2013.01); *G03G 21/1642* (2013.01); *G03G 2221/169* (2013.01); *G03G 2221/1687* (2013.01)

(58) Field of Classification Search
CPC ..... G03G 21/1633; G03G 21/1638; G03G 21/16; G03G 21/1604; G03G 21/1623; G03G 21/1642; G03G 21/1647; G03G 2221/1687; G03G 2221/169
See application file for complete search history.

(56) References Cited

U.S. PATENT DOCUMENTS

2015/0307311 A1 10/2015 Ono
2016/0124370 A1* 5/2016 Miwa ..... G03G 15/6552 399/405
2019/0129357 A1 5/2019 Tanaka et al.

FOREIGN PATENT DOCUMENTS

JP 2010-262075 A 11/2010
JP 2013-054183 A 3/2013
JP 2014-133624 A 7/2014
JP 2017-021209 A 1/2017

* cited by examiner

*Primary Examiner* — Hoang X Ngo
(74) *Attorney, Agent, or Firm* — Canon U.S.A., Inc. IP Division

(57) ABSTRACT

An image forming apparatus includes an apparatus main body to which a cartridge is detachably attached. The apparatus main body includes a frame having an opening portion through which the cartridge is attached to the apparatus main body; an opening and closing member supported by the frame rotatably between an open position in which the opening portion is exposed and a closed position in which the opening portion is covered with the opening and closing member and having a stacking surface on which a sheet is to be stacked; a discharging roller discharging the sheet in a discharging direction onto the stacking surface; and a regulating wall which is movably attached to the opening and closing member and extends from the stacking surface toward the discharging roller in a direction intersecting the discharging direction to regulate an upstream edge of the sheet in the discharging direction.

10 Claims, 19 Drawing Sheets

IMAGE FORMING APPARATUS

BACKGROUND OF THE INVENTION

Field of the Invention

The present invention relates to image forming apparatuses, such as laser beam printers, copiers, and facsimile apparatuses.

Description of the Related Art

A known image forming apparatus disclosed in Japanese Patent Application Laid-Open No. 2014-133624 having a cartridge and an apparatus main body to which the cartridge is detachably attached includes a frame with an opening portion used for attaching and detaching the cartridge, an opening and closing member that rotates between a position in which the opening and closing member blocks the opening portion and a position in which the opening and closing member exposes the opening portion and whose upper surface serves as a sheet stacking surface, and a discharging roller for discharging a sheet onto the stacking surface.

The opening and closing member is conceivably provided with a regulating wall configured to regulate the position of the trailing edge of the sheet stacked on the sheet stacking surface.

In recent years, the apparatus main body of the image forming apparatus has been reduced in size for reducing the installation space. Meanwhile, the cartridge has been increased in size due to, for example, an increase in capacity for toners. Thus, there is a demand for an image forming apparatus in which the opening and closing member can be opened and closed in a compact fashion without posing an impediment to the attachment and detachment processes of the cartridge and also without interfering with the apparatus main body.

SUMMARY OF THE INVENTION

A first aspect of the present invention provides an image forming apparatus comprising: a cartridge; and an apparatus main body to which the cartridge is detachably attached, the apparatus main body including: a frame in which an opening portion, through which the cartridge is attached to the apparatus main body, is formed; an opening and closing member configured to move between an open position in which the opening and closing member is opened to expose the opening portion and a closed position in which the opening and closing member is closed to cover the opening portion, the opening and closing member having a supported portion supported by the frame so that the opening and closing member is rotatable about a rotational axis, the opening and closing member having a stacking surface on which a sheet is to be stacked when the opening and closing member is located in the closed position; a discharging roller configured to discharge the sheet in a discharging direction onto the stacking surface when the opening and closing member is located in the closed position; and a regulating wall configured to regulate a position of an upstream edge, in the discharging direction, of the sheet stacked on the stacking surface, the regulating wall extending from the stacking surface toward the discharging roller in an intersecting direction intersecting the discharging direction, the regulating wall being movably attached to the opening and closing member.

A second aspect of the present invention provides an image forming apparatus comprising: a cartridge; and an apparatus main body to which the cartridge is detachably attached, the apparatus main body including: a frame in which an opening portion, through which the cartridge is attached to the apparatus main body, is formed; a discharging roller configured to discharge a sheet in a discharging direction; an opening and closing member configured to move between an open position in which the opening and closing member is opened to expose the opening portion and a closed position in which the opening and closing member is closed to cover the opening portion, the opening and closing member having a supported portion supported by the frame so that the opening and closing member is rotatable about a rotational axis, the opening and closing member having a stacking surface on which the sheet discharged by the discharging roller is to be stacked when the opening and closing member is located in the closed position, the supported portion being movable between a first position and a second position located downstream of the first position in the discharging direction, the supported portion being located in the first position when the opening and closing member is located in the closed position and being located in the second position when the opening and closing member is located in the open position; and a regulating wall configured to regulate a position of an upstream edge, in the discharging direction, of the sheet stacked on the stacking surface, the regulating wall extending from the stacking surface toward the discharging roller in an intersecting direction intersecting the discharging direction, the regulating wall being attached to the opening and closing member.

Further features of the present invention will become apparent from the following description of exemplary embodiments with reference to the attached drawings.

DESCRIPTION OF THE EMBODIMENTS

First Embodiment

Figure 1:
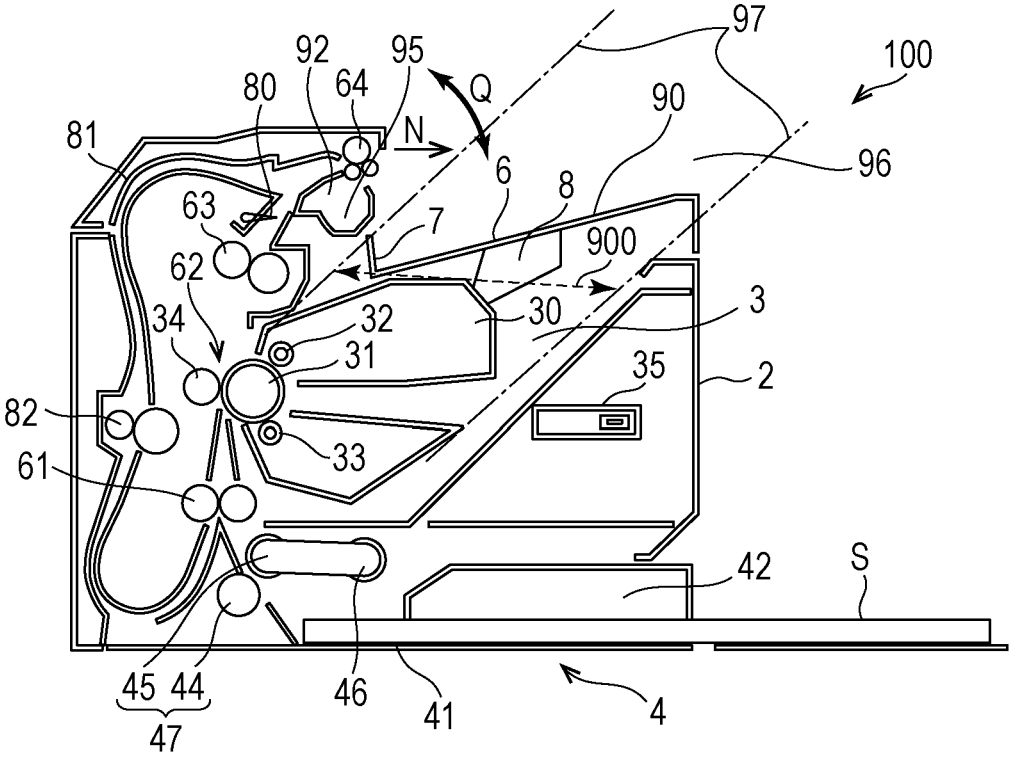
FIG. 1 is a cross-sectional view illustrating the overall configuration of an image forming apparatus according to a first embodiment.

An image forming apparatus 100 according to the first embodiment will be described below. The configuration of the image forming apparatus 100 of an electrophotographic type will be described with reference to FIG. 1. FIG. 1 is a cross-sectional view illustrating the overall configuration of the image forming apparatus 100.

1. Image Forming Apparatus

As shown in FIG. 1, the image forming apparatus 100 has a process cartridge 30 and an apparatus main body 2 to and from which the process cartridge 30 is attachable and detachable through an attachment-detachment region 96 (i.e., a region between single-dot chain lines 97). The process cartridge 30 has a photosensitive drum 31 that carries a toner image, a charging roller 32 that uniformly electrostatically charges the surface of the photosensitive drum 31, and a developing member 33 that supplies toner onto the photosensitive drum 31.

An image forming unit 3 for forming a toner image onto a sheet S includes the process cartridge 30, a transfer roller 34 that transfers the toner image formed on the photosensitive drum 31 onto the sheet S, and a laser scanner 35 that radiates laser light onto the photosensitive drum 31.

An image forming process performed in the image forming unit 3 will be described. The surface of the photosensitive drum 31 is electrostatically charged uniformly by the charging roller 32. Then, based on an image signal from a host computer (not shown), the laser scanner 35 radiates laser light onto the photosensitive drum 31 having the electrostatically-charged surface, thereby forming an electrostatic latent image on the surface of the photosensitive drum 31. Subsequently, a toner image is formed on the photosensitive drum 31 by using toner supplied from the developing member 33.

A sheet feeding device 4 is provided at a lower section of the image forming apparatus 100. The sheet feeding device 4 has a container 41 in which sheets S are contained and a regulating plate 42 that regulates the sheets S contained in the container 41 in the width direction thereof. Furthermore, a pair of separation rollers 47 constituted of a contact roller 44 and a driving roller 45 is provided. Moreover, a pickup roller 46 pivotable about the driving roller 45 is also provided.

Figure 2:
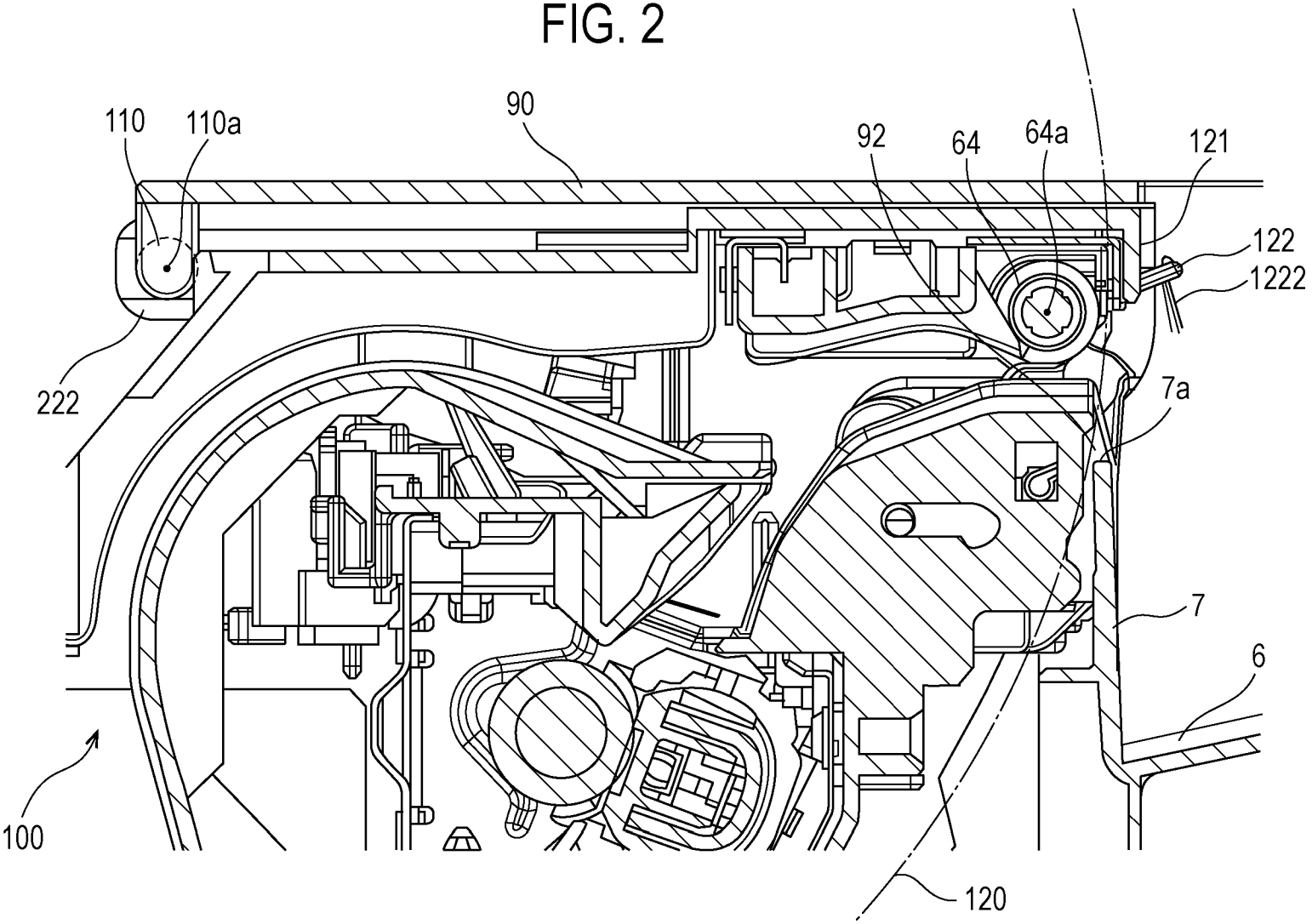
FIG. 2 is an enlarged cross-sectional view of the image forming apparatus, illustrating an enlarged view of a discharging roller and the vicinity thereof when an opening and closing member is located in a closed position, in accordance with the first embodiment.

As a result of the pickup roller 46 pivoting to come into contact with a sheet S based on a print signal, the sheet S is conveyed toward the pair of separation rollers 47. Then, a conveying roller 61 conveys the sheet S to a transfer unit 62, constituted of the photosensitive drum 31 and the transfer roller 34, in which a toner image is transferred onto the sheet S. The sheet S having the toner image transferred thereon undergoes a toner-image fixing process at a fixing unit 63, and is sequentially discharged by a discharging roller (discharging member) 64 onto a sheet stacking surface 6 at the upper surface of the apparatus main body 2. The discharging roller 64 is configured to rotate around a second rotational axis 64*a* (FIG. 2).

The following description relates to a case of duplex printing. A fixation discharge sensor 80 is provided between the fixing unit 63 and the discharging roller 64. Moreover, a duplex conveying path 81 connecting the discharging roller 64 and the conveying roller 61, a pair of duplex conveying rollers 82 provided at an intermediate section of the duplex conveying path 81, and a shutter member (not shown) provided in the pair of duplex conveying rollers 82 are also provided.

When a predetermined time period elapses after the trailing edge of the sheet S conveyed by the discharging roller 64 is detected by the fixation discharge sensor 80, a drive switching unit (not shown) causes the discharging roller 64 to rotate in a direction opposite to the direction in which the sheet S is discharged onto the sheet stacking surface 6. Consequently, the sheet S is conveyed along the duplex conveying path 81. Subsequently, when the sheet S passes through the pair of duplex conveying rollers 82, the sheet S undergoes a skew correcting process by having its leading edge brought into abutment with the shutter member (not shown) and then nipped by the pair of duplex conveying rollers 82, so that the skew of the sheet S is corrected. The sheet S subsequently reaches the conveying roller 61. The subsequent process is the same as that for the first face of the sheet S and therefore will not be described again.

The apparatus main body 2 has a frame 222 (FIG. 2) with an opening portion 900 through which the process cartridge 30 passes during the attachment and detachment processes of the process cartridge 30, and also has an opening and closing member 90 configured to be rotatable between a closed position in which the opening and closing member 90 covers the opening portion 900 and an open position in which the opening and closing member 90 exposes the opening portion 900. The opening and closing member 90 has the sheet stacking surface 6 onto which a sheet discharged by the discharging roller 64 is stacked, and also has a regulating wall 7 configured to regulate the position of the trailing edge of the sheet stacked on the sheet stacking surface 6. The opening and closing member 90 further has a pressing portion (pressing member) 8 that presses against the process cartridge 30.

The discharging roller 64 is disposed at the lowest position possible in the height direction for reducing the size of the apparatus main body 2. In a discharging direction N of the discharging roller 64, the discharging roller 64 is disposed toward the downstream side for ensuring a distance X (not shown) used for inverting the sheet S.

2. Configuration of Opening And Closing Member

A detailed configuration of the opening and closing member 90 will be described with reference to FIGS. 2 to 9B. FIG. 2 is an enlarged cross-sectional view of the discharging roller 64 and the vicinity thereof in the image forming apparatus 100, taken in a direction orthogonal to the second rotational axis 64*a* when the opening and closing member 90 is located in the closed position. The opening and closing member 90 has a supported portion 110 supported in a rotatable manner around a first rotational axis in the direction of an arrow Q (FIGS. 1 and 3) 110*a* relative to the frame 222 of the apparatus main body 2. As shown in FIG. 2, the direction of the first rotational axis 110*a* is the direction extending along the second rotational axis 64*a* of the discharging roller 64.

Figure 3:
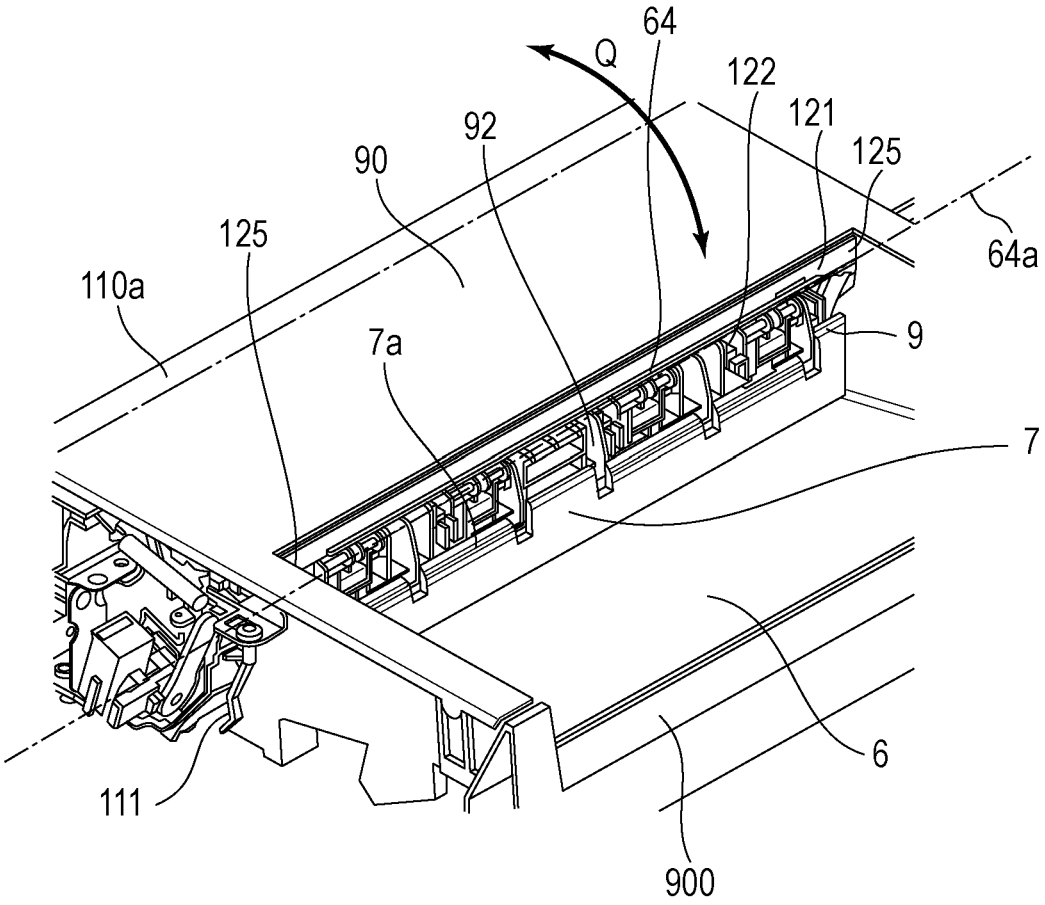
FIG. 3 is a perspective view of the image forming apparatus, illustrating an enlarged view of the discharging roller and the vicinity thereof when the opening and closing member is located in the closed position, in accordance with the first embodiment.

As shown in FIGS. 2 and 3, the opening and closing member 90 has the sheet stacking surface 6 onto which a sheet (recording medium) discharged by the discharging roller 64 is stacked, and also has the regulating wall 7 configured to regulate the position of the trailing edge of the sheet stacked on the sheet stacking surface 6. The opening and closing member 90 is configured to be rotatable between the closed position, indicated with a dashed line in FIG. 1, in which the opening and closing member 90 covers the opening portion 900 and the open position in which the opening and closing member 90 exposes the opening portion 900. As shown in FIG. 2, the regulating wall 7 extends from the sheet stacking surface 6 toward the discharging roller 64 in the direction intersecting the sheet stacking surface 6 when the opening and closing member 90 is located in the closed position. The end portion of the regulating wall 7 at the far side from the sheet stacking surface 6 is defined as an end portion 7*a*.

A dashed line 120 in FIG. 2 is an imaginary circle that is centered on the first rotational axis 110*a* when the opening and closing member 90 is closed and in which the distance between the first rotational axis 110*a* and the end portion 7*a* of the regulating wall 7 is defined as the radius. In FIG. 2, an outer cover 121 and a protrusion 122 are located outside the dashed line 120. The protrusion 122 supports a charge removing member 1222 that comes into contact with a sheet S discharged by the discharging roller 64 to remove electrostatic charge from the sheet S.

Figure 4:
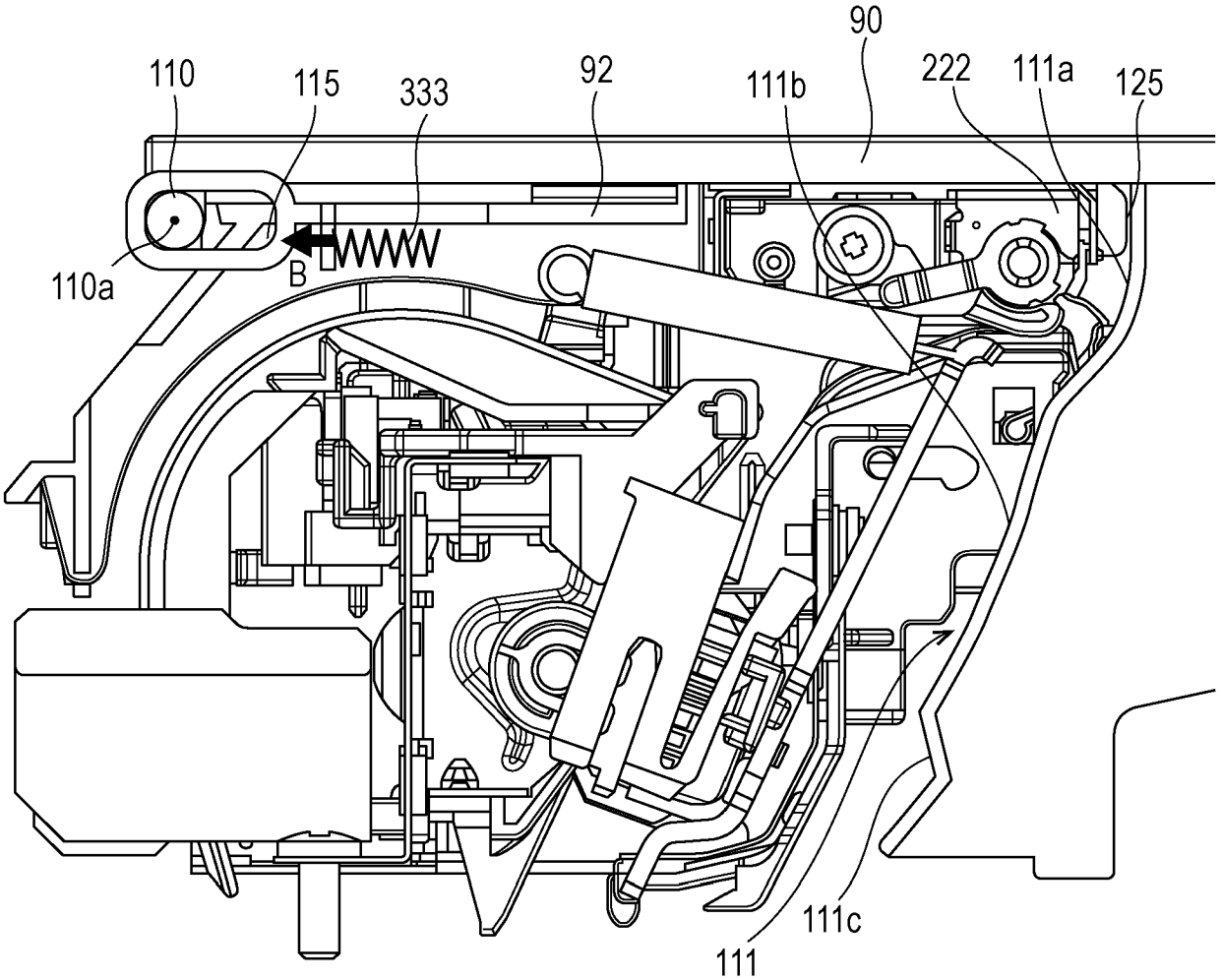
FIG. 4 is an enlarged cross-sectional view of the image forming apparatus, illustrating an enlarged view of the discharging roller and the vicinity thereof when the opening and closing member is located in the closed position, in accordance with the first embodiment.
Figure 5:
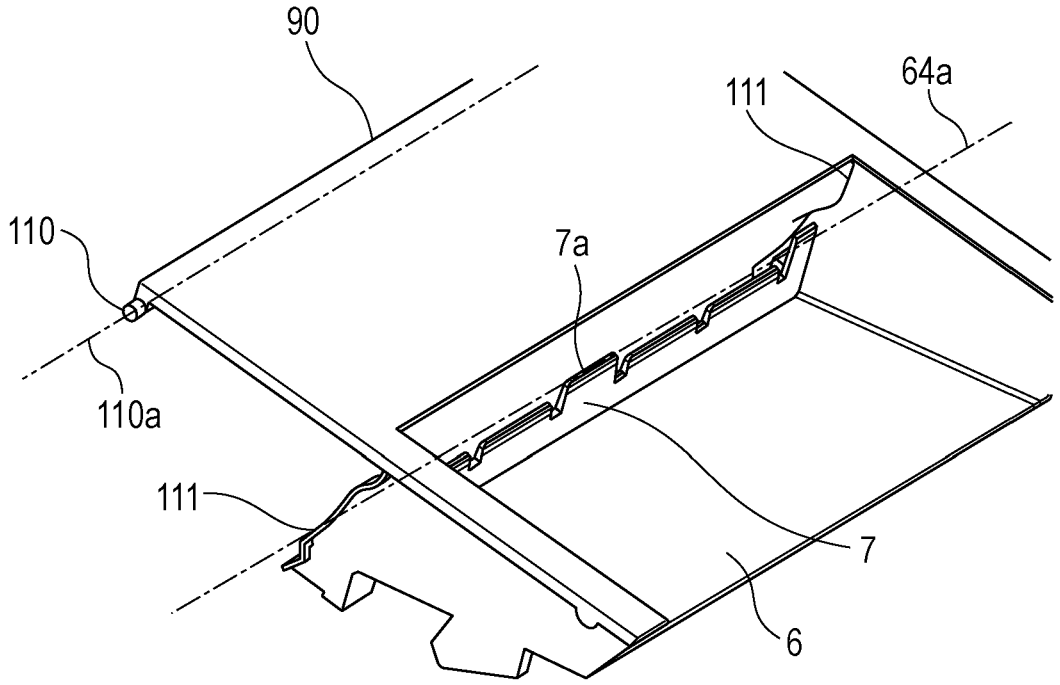
FIG. 5 is a perspective view of the opening and closing member according to the first embodiment.

FIG. 3 is an enlarged perspective view of the discharging roller 64 and the vicinity thereof in the image forming apparatus 100 when the opening and closing member 90 is located in the closed position. FIG. 4 is an enlarged cross-sectional view of the discharging roller 64 and the vicinity thereof in the image forming apparatus 100 when the opening and closing member 90 is located in the closed position. The cross section in FIG. 4 is orthogonal to the second rotational axis 64*a* in a region outside the regulating wall 7 in the direction of the second rotational axis 64*a* in the image forming apparatus 100. FIG. 5 is a perspective view of the opening and closing member 90.

As shown in FIG. 3, the end portion 7*a* of the regulating wall 7 is comb-teeth-shaped. As shown in FIG. 4, the supported portion 110 of the opening and closing member 90 is fitted in a long hole 115 provided in a cover 92. As shown in FIGS. 3, 4, and 5, the opening and closing member 90 has cam surfaces 111 at opposite end portions located outside the regulating wall 7 with respect to the direction of the first rotational axis 110*a*. As shown in FIG. 4, the cam surfaces 111 face the frame 222 and each have a first region 111*a*, a second region 111*b*, and a third region 111*c*. The second region 111*b* of each cam surface 111 is positionally closer to the first rotational axis 110*a* than the first region 111*a*, and is provided upstream of the first region 111*a* in the direction in which the opening and closing member 90 rotates from the closed position toward the open position. The third region 111*c* is positionally farther from the first rotational axis 110*a* than the second region 111*b*, and is provided upstream of the second region 111*b* in the direction in which the opening and closing member 90 rotates from the closed position toward the open position.

The cover 92 of the image forming apparatus 100 is provided with the long hole 115 into which the supported portion 110 is fitted and a compression spring 333 that biases the supported portion 110 in the direction of an arrow B. The frame 222 has a contact portion 125 configured to come into contact with the cam surfaces 111 while the opening and closing member 90 rotates.

Next, the position of the end portion 7*a* of the regulating wall 7 when the opening and closing member 90 rotates around the first rotational axis 110*a* from the closed position to the open position will be described with reference to FIGS. 6A, 6B, 7A, 7B, 8A, 8B, 9A, and 9B.

Figure 6A:
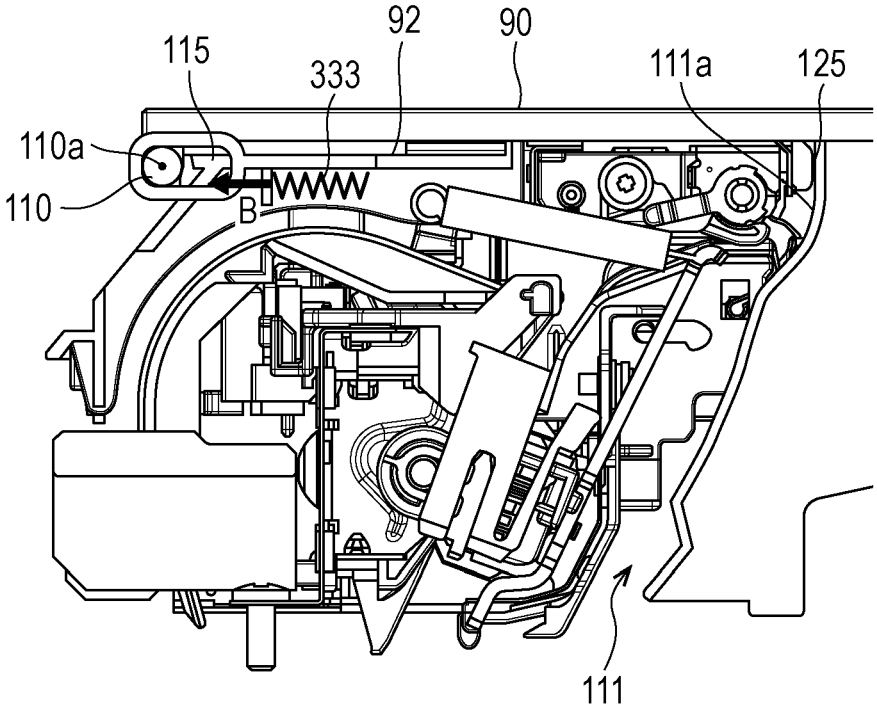
FIG. 6A is a cross-sectional view of a position in which a cam surface near the discharging roller is located when the opening and closing member is located in the closed position, in accordance with the first embodiment.
Figure 6B:
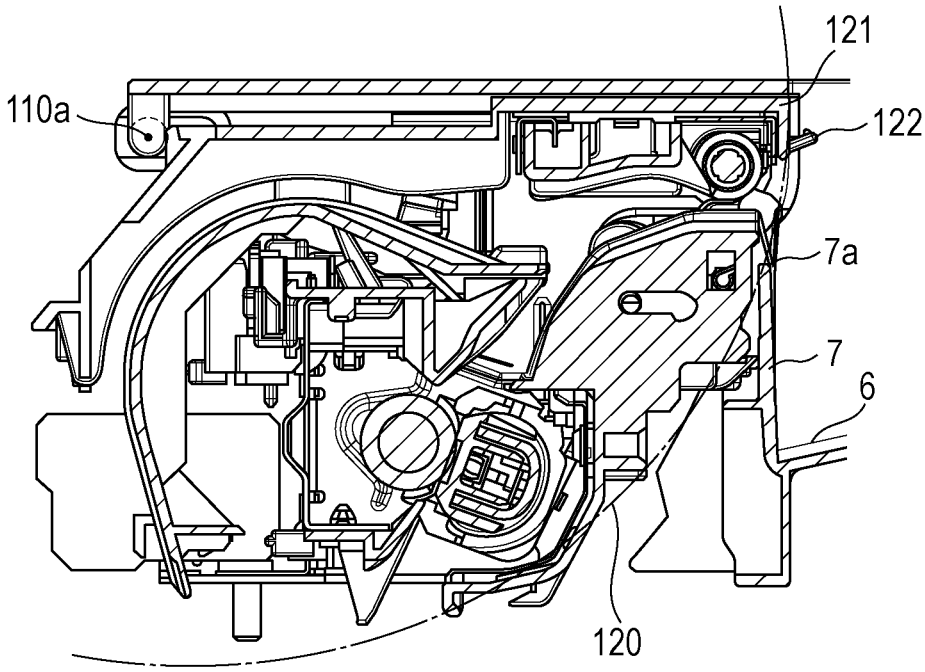
FIG. 6B is a cross-sectional view of a position in which a regulating wall near the discharging roller is located when the opening and closing member is located in the closed position, in accordance with the first embodiment.

FIGS. 6A and 6B are cross-sectional views of the discharging roller 64 and the vicinity thereof in the image forming apparatus 100, taken in a direction orthogonal to the first rotational axis 110*a* when the opening and closing member 90 is located in the closed position. Specifically, FIG. 6A is a cross-sectional view of a region in which a cam surface 111 is located with respect to the direction of the first rotational axis 110*a*, and FIG. 6B is a cross-sectional view of a region in which the regulating wall 7 is located with respect to the direction of the first rotational axis 110*a*. In FIGS. 6A and 6B, the supported portion 110 of the opening and closing member 90 is biased in the direction of the arrow B by the spring 333 so as to be located at a far end portion (first position) of the long hole 115 with respect to the sheet stacking surface 6. The first region 111*a* of the cam surface 111 of the opening and closing member 90 is in contact with the contact portion 125. A dashed line 120 in FIG. 6B is an imaginary circle that is centered on the first rotational axis 110*a* when the supported portion 110 is located in the first position and in which the distance between the first rotational axis 110*a* and the end portion 7*a* of the regulating wall 7 is defined as the radius. The end portion 7*a* of the regulating wall 7 is located where the dashed line 120 coincides with the discharging roller 64, the outer cover 121, and the protrusion 122.

Figure 7A:
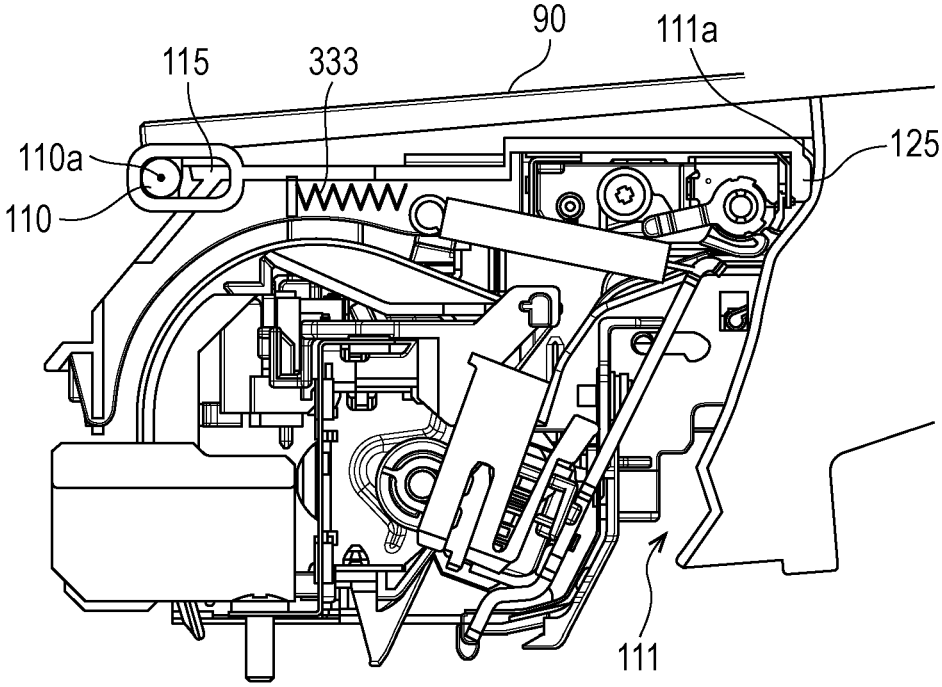
FIG. 7A is a cross-sectional view of the position in which the cam surface near the discharging roller is located when the opening and closing member has rotated by 10 degrees from the closed position to an open position, in accordance with the first embodiment.
Figure 7B:
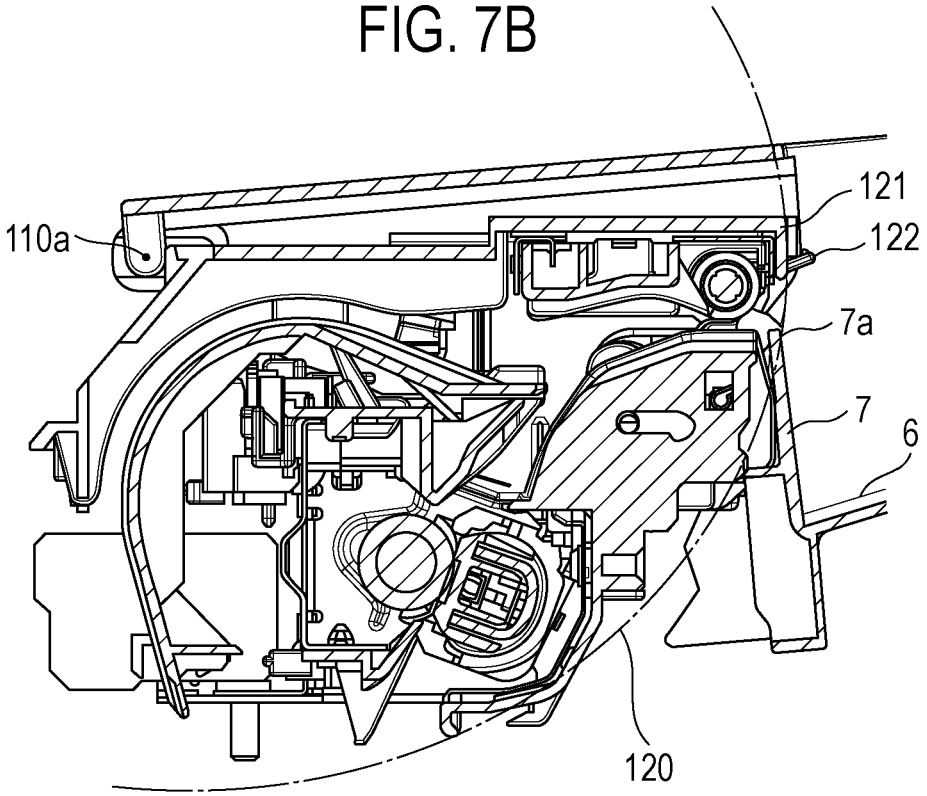
FIG. 7B is a cross-sectional view of the position in which the regulating wall near the discharging roller is located when the opening and closing member has rotated by 10 degrees from the closed position to the open position, in accordance with the first embodiment.

FIGS. 7A and 7B are cross-sectional views of the discharging roller 64 and the vicinity thereof in the image forming apparatus 100, taken in a direction orthogonal to the first rotational axis 110*a* when the opening and closing member 90 has rotated by 10 degrees from the closed position shown in FIGS. 6A and 6B. Specifically, FIG. 7A is a cross-sectional view of the region in which a cam surface 111 is located with respect to the direction of the first rotational axis 110*a*, and FIG. 7B is a cross-sectional view of the region in which the regulating wall 7 is located with respect to the direction of the first rotational axis 110*a*.

As shown in FIG. 7A, similar to FIG. 6A, the first region 111*a* of the cam surface 111 is in contact with the contact portion 125, and the supported portion 110 is located in the first position. As shown in FIG. 7B, similar to FIG. 6B, the dashed line 120 coincides with the discharging roller 64, the outer cover 121, and the protrusion 122. The angle of 10 degrees is the angle at which the supported portion 110 starts to move in the direction of the arrow B from the first position of the long hole 115.

Figure 8A:
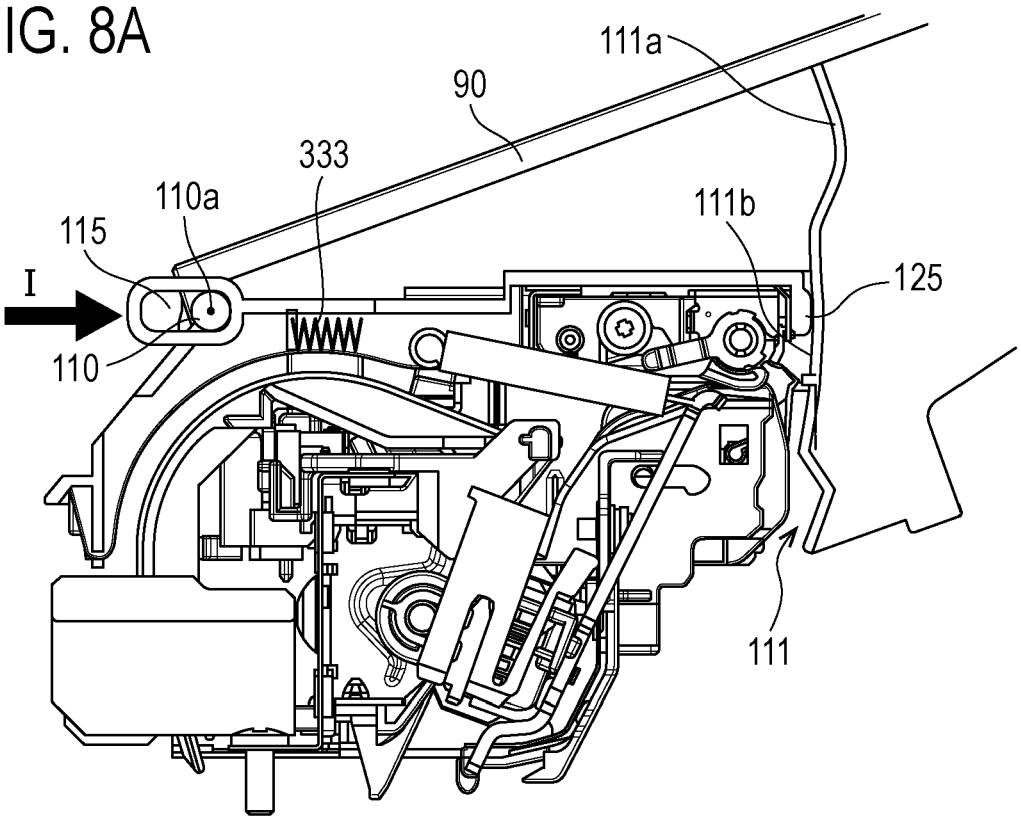
FIG. 8A is a cross-sectional view of the position in which the cam surface near the discharging roller is located when the opening and closing member has rotated by 20 degrees from the closed position to the open position, in accordance with the first embodiment.
Figure 8B:
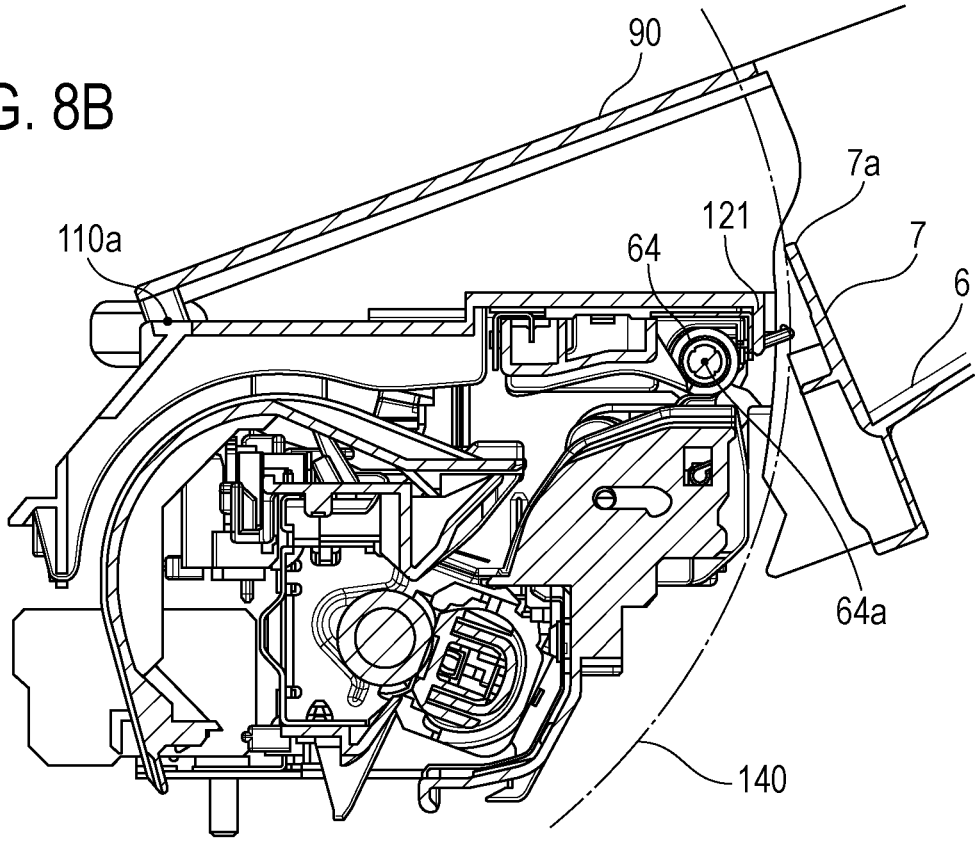
FIG. 8B is a cross-sectional view of the position in which the regulating wall near the discharging roller is located when the opening and closing member has rotated by 20 degrees from the closed position to the open position, in accordance with the first embodiment.

FIGS. 8A and 8B are cross-sectional views of the discharging roller 64 and the vicinity thereof in the image forming apparatus 100, taken in a direction orthogonal to the first rotational axis 110*a* when the opening and closing member 90 has rotated by 20 degrees from the closed position. Specifically, FIG. 8A is a cross-sectional view of the region in which a cam surface 111 is located with respect to the direction of the first rotational axis 110*a*, and FIG. 8B is a cross-sectional view of the region in which the regulating wall 7 is located with respect to the direction of the first rotational axis 110*a*.

As shown in FIG. 8A, the second region 111*b* of the cam surface 111 is in contact with the contact portion 125.

In the sheet discharging direction N of the discharging roller 64, the second region 111*b* is located closer toward the supported portion 110 than the first region 111*a*. Therefore, the region of the cam surface 111 coming into contact with the contact portion 125 changes from the first region 111*a* to the second region 111*b* while the opening and closing member 90 rotates by 20 degrees from the closed position. When the second region 111*b* of the cam surface 111 comes into contact with the contact portion 125, the second region 111*b* is pressed against the contact portion 125, so that the opening and closing member 90 moves against the spring force of the spring 333 in the discharging direction N (i.e., the direction of an arrow I) for the sheet S by the discharging roller 64. As a result, as shown in FIG. 8A, the supported portion 110 moves to a second position at a near end portion of the long hole 115 with respect to the sheet stacking surface 6. The second position is closer to the sheet stacking surface 6 than the first position in the discharging direction N of the discharging roller 64.

A dashed line 140 in FIG. 8B is an imaginary circle that is centered on the first rotational axis 110*a* when the supported portion 110 is located in the second position and in which the distance between the first rotational axis 110*a* and the end portion 7*a* of the regulating wall 7 is defined as the radius. The dashed line 140 is located outside the outer cover 121 and the protrusion 122. Therefore, when the supported portion 110 is located in the second position, the end portion 7*a* of the regulating wall 7 does not interfere with the outer cover 121 and the protrusion 122 even when the opening and closing member 90 is rotated around the first rotational axis 110*a*.

Figure 9A:
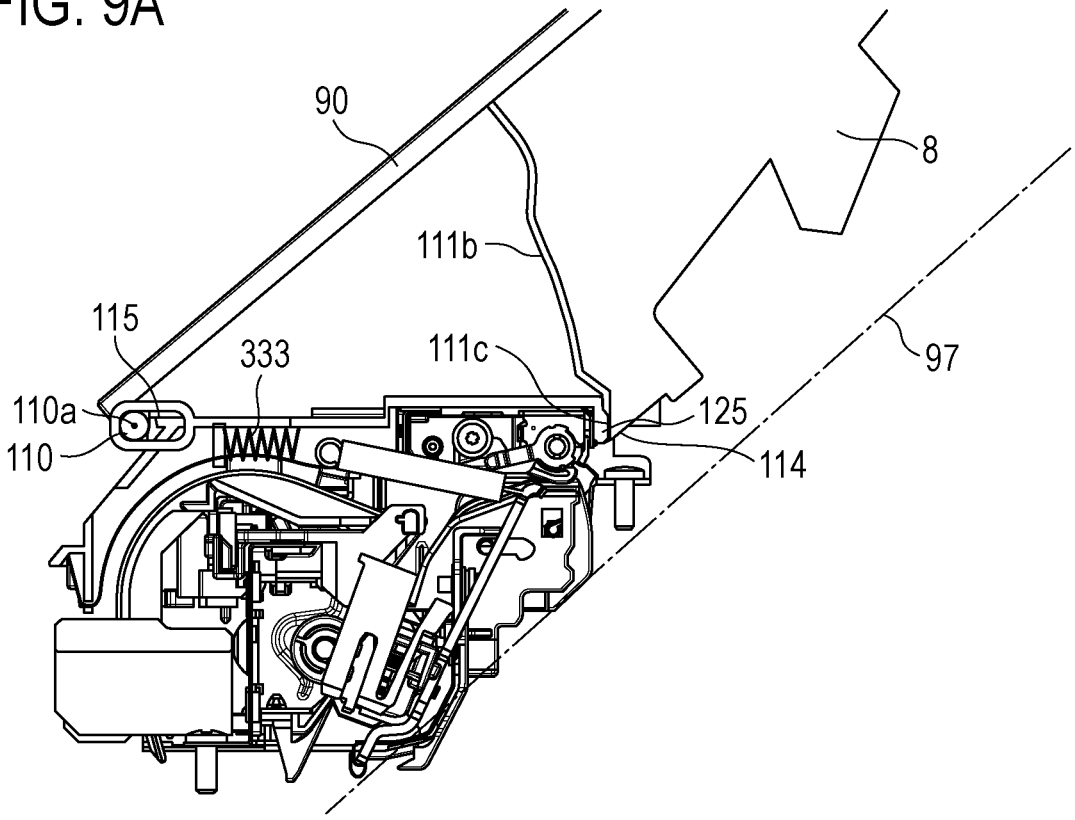
FIG. 9A is a cross-sectional view of the position in which the cam surface near the discharging roller is located when the opening and closing member has rotated by 40 degrees from the closed position to the open position, in accordance with the first embodiment.
Figure 9B:
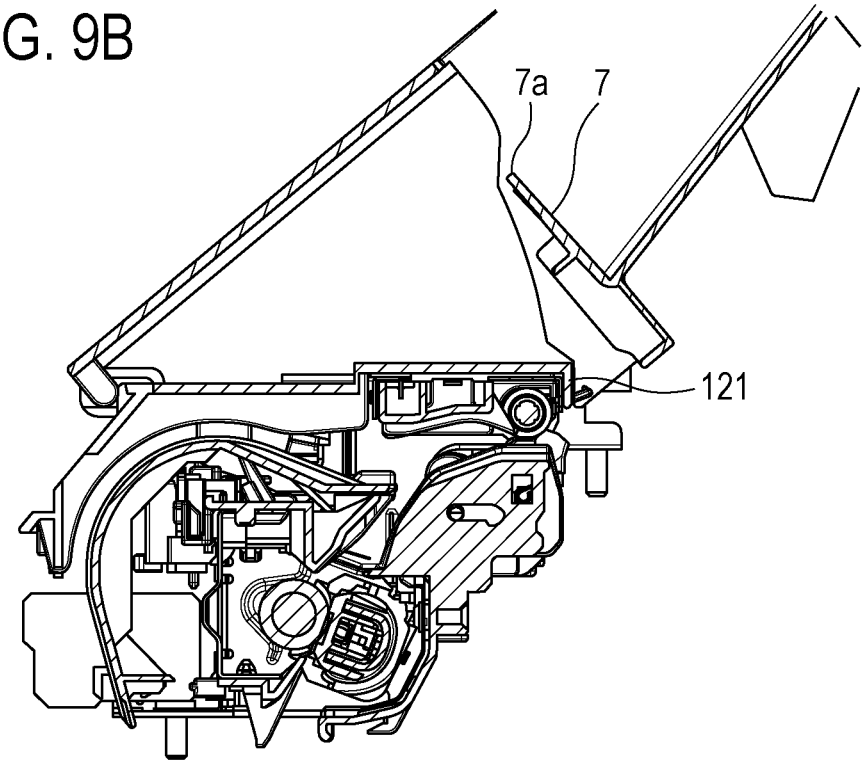
FIG. 9B is a cross-sectional view of the position in which the regulating wall near the discharging roller is located when the opening and closing member has rotated by 40 degrees from the closed position to the open position, in accordance with the first embodiment.

FIGS. 9A and 9B are cross-sectional views of the discharging roller 64 and the vicinity thereof in the image forming apparatus 100, taken in a direction orthogonal to the first rotational axis 110*a* when the opening and closing member 90 has rotated by 40 degrees from the closed position. Specifically, FIG. 9A is a cross-sectional view of the region in which a cam surface 111 is located with respect to the direction of the first rotational axis 110*a*, and FIG. 9B is a cross-sectional view of the region in which the regulating wall 7 is located with respect to the direction of the first rotational axis 110*a*.

As shown in FIG. 9A, the third region 111*c* of the cam surface 111 is in contact with the contact portion 125.

In the sheet discharging direction N of the discharging roller 64, the third region 111*c* is located farther from the supported portion 110 than the second region 111*b*. Therefore, the region of the cam surface 111 coming into contact with the contact portion 125 changes from the second region 111*b* to the third region 111*c* while the opening and closing member 90 rotates from 20 degrees to 40 degrees. As a result, the opening and closing member 90 moves toward the supported portion 110 (in the direction of the arrow B) in accordance with the spring force of the spring 333 until the third region 111*c* of the cam surface 111 comes into contact with the contact portion 125, and the supported portion 110 moves to the first position of the long hole 115, as shown in FIG. 9A.

In accordance with the configuration described above, the opening and closing member 90 can be retracted outside the region through which the process cartridge 30 passes during the attachment and detachment processes of the process cartridge 30, without increasing the height of the apparatus main body 2 or increasing the rotational angle of the opening and closing member 90.

Figure 10:
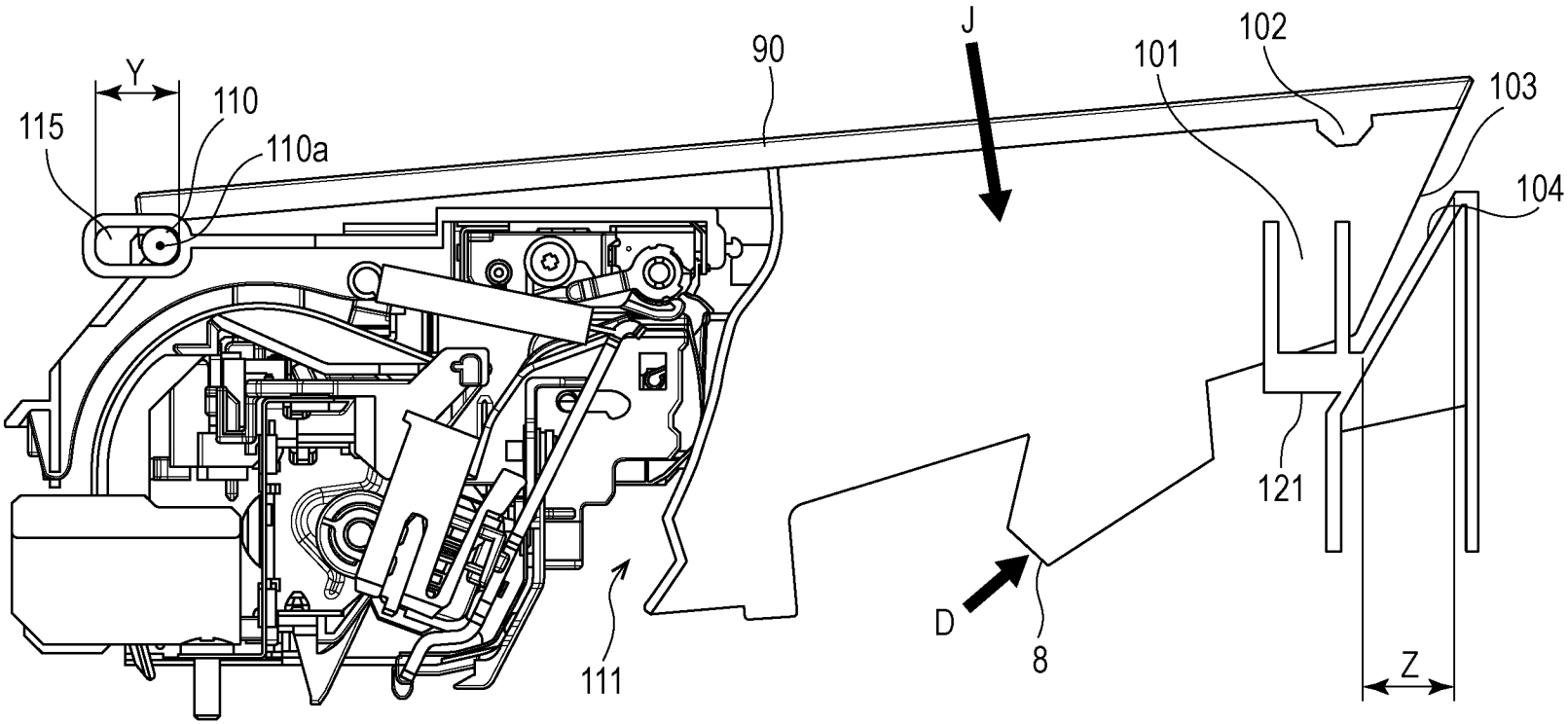
FIG. 10 is a cross-sectional view of the position in which the cam surface near the discharging roller is located when the opening and closing member is located near the closed position, in accordance with the first embodiment.

Next, FIG. 10 is a cross-sectional view of the region in which a cam surface 111 is located with respect to the direction of the first rotational axis 110*a* when the opening and closing member 90 is located in a position near the closed position. While the opening and closing member 90 rotates from the open position to the closed position, the opening and closing member 90 receives a reaction force in the direction of an arrow D from the pressing portion 8 that presses the process cartridge 30 toward an image formation position. The following configuration is provided for preventing the supported portion 110 of the opening and closing member 90 from moving from the first position toward the second position in the long hole 115 due to the reaction force.

The opening and closing member 90 has a regulated surface 103 and a positioning boss 102, and the apparatus main body 2 has a regulator (regulating surface) 104. The regulator 104 comes into contact with the regulated surface 103 of the opening and closing member 90 so as to regulate the movement of the supported portion 110 of the opening and closing member 90 in the direction of the arrow D when the opening and closing member 90 rotates from the open position toward the closed position in the direction of an arrow J.

By making a regulation width Z of the regulating surface 104 larger than a longitudinal length Y of the long hole 115, the opening and closing member 90 can be rotated to the closed position. Furthermore, when the opening and closing member 90 is located in the closed position, the positioning boss 102 of the opening and closing member 90 is fitted into a hole 101 in the outer cover 121, so that the opening and closing member 90 can be made positionally stable.

Figure 11:
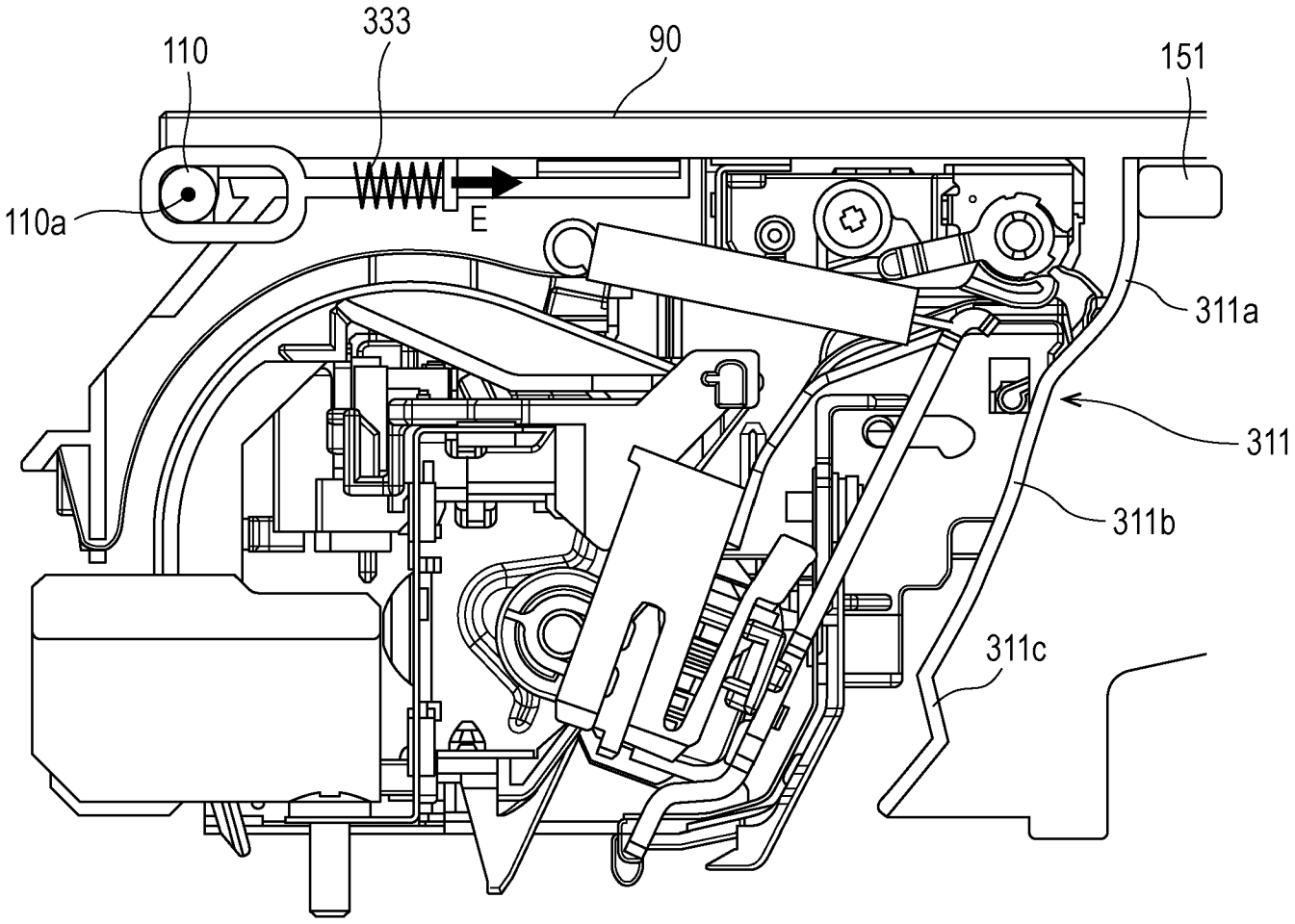
FIG. 11 is a cross-sectional view of the position in which the cam surface near the discharging roller is located when an opening and closing member according to a first modification of the first embodiment is located in the closed position.

The configuration of a first modification of this embodiment will now be described with reference to FIG. 11. As shown in FIG. 11, the spring 333 is configured to apply pressure in the direction (of an arrow E) in which the supported portion 110 moves from the first position toward the second position. A contact portion 151 is provided facing cam surfaces 311 so that the cam surfaces 311 each having a first region 311*a*, a second region 311*b*, and a third region 311*c* are oriented outside, which is opposite to that in the above embodiment. When the opening and closing member 90 is rotated from the closed position toward the open position, the contact portion 151 comes into contact with the first region 311*a*, the second region 311*b*, and the third region 311*c* of each cam surface 311 in this sequence. When the second region 311*b* of the cam surface 311 is in contact with the contact portion 151, the distance of the second region 311*b* from the first rotational axis 110*a* is shorter than that of the first region 311*a*, so that the supported portion 110 is pressed and moved by the spring 333 by that amount in the direction of the arrow E. As a result, the supported portion 110 moves together with the regulating wall 7 in the direction of the arrow E, so that the opening and closing member 90 can rotate from the closed position to the open position without interference.

Figure 12:
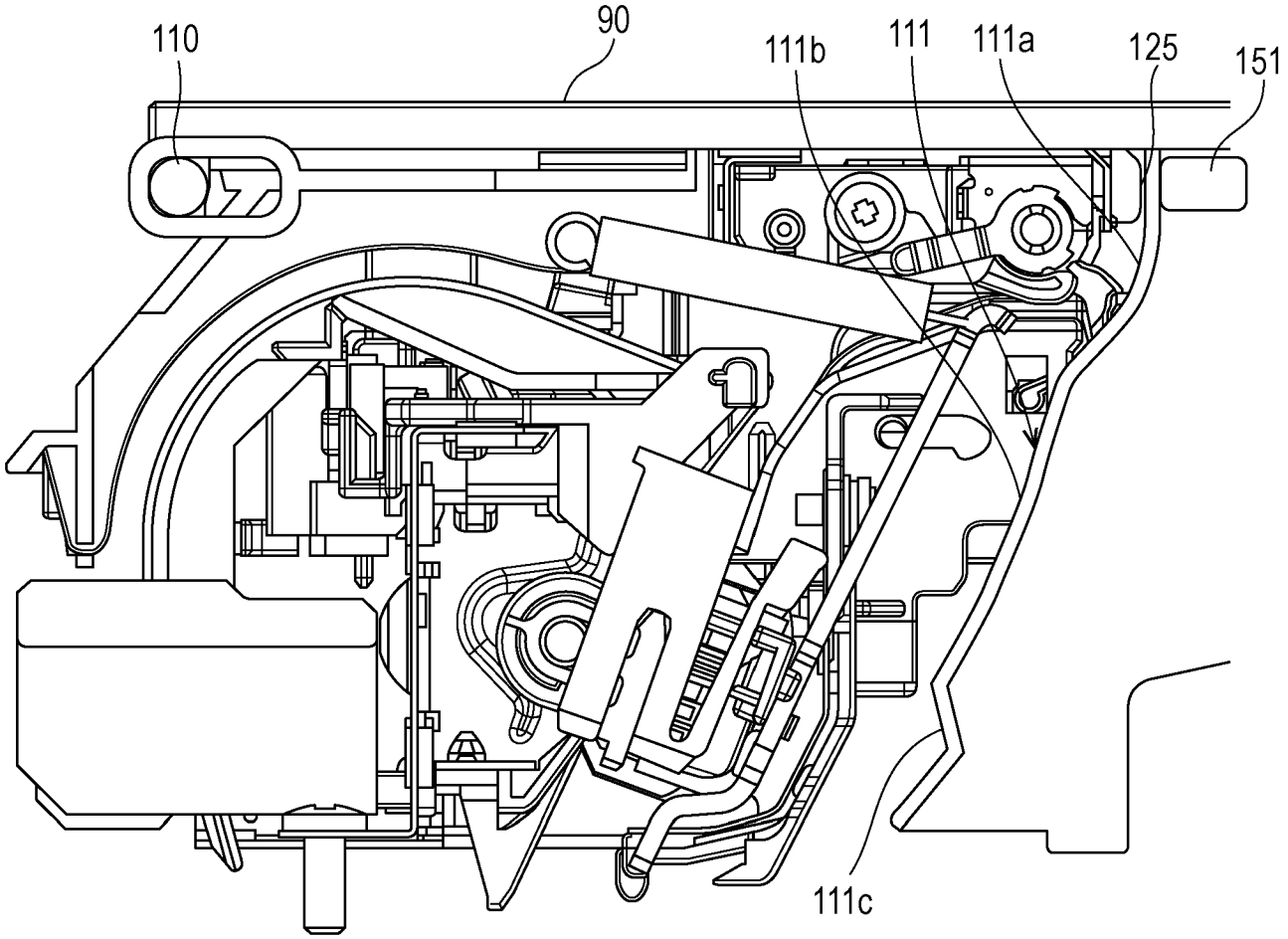
FIG. 12 is a cross-sectional view of the position in which the cam surface near the discharging roller is located when the opening and closing member according to the first modification of the first embodiment is located in the closed position.

Next, a second modification of this embodiment will be described with reference to FIG. 12. As shown in FIG. 12, the cam surfaces 111 are interposed between the contact portion 125 and the contact portion 151, so that the forward and backward movement of the opening and closing member 90 is regulated during the opening-closing operation thereof, thereby achieving advantages similar to those of the first embodiment even if a spring that presses against the supported portion 110 is omitted.

As described above, this embodiment can provide an image forming apparatus in which the opening and closing member can be opened and closed in a compact fashion without posing an impediment to the attachment and detachment processes of the cartridge and also without interfering with the apparatus main body. The term "interfere" used here has a meaning in which the opening and closing member comes into contact with a part of the apparatus main body other than the opening and closing member to an extent that the opening and closing member is not openable and closable, and does not include contact to an extent that the opening and closing member is openable and closable.

Second Embodiment

Figure 13:
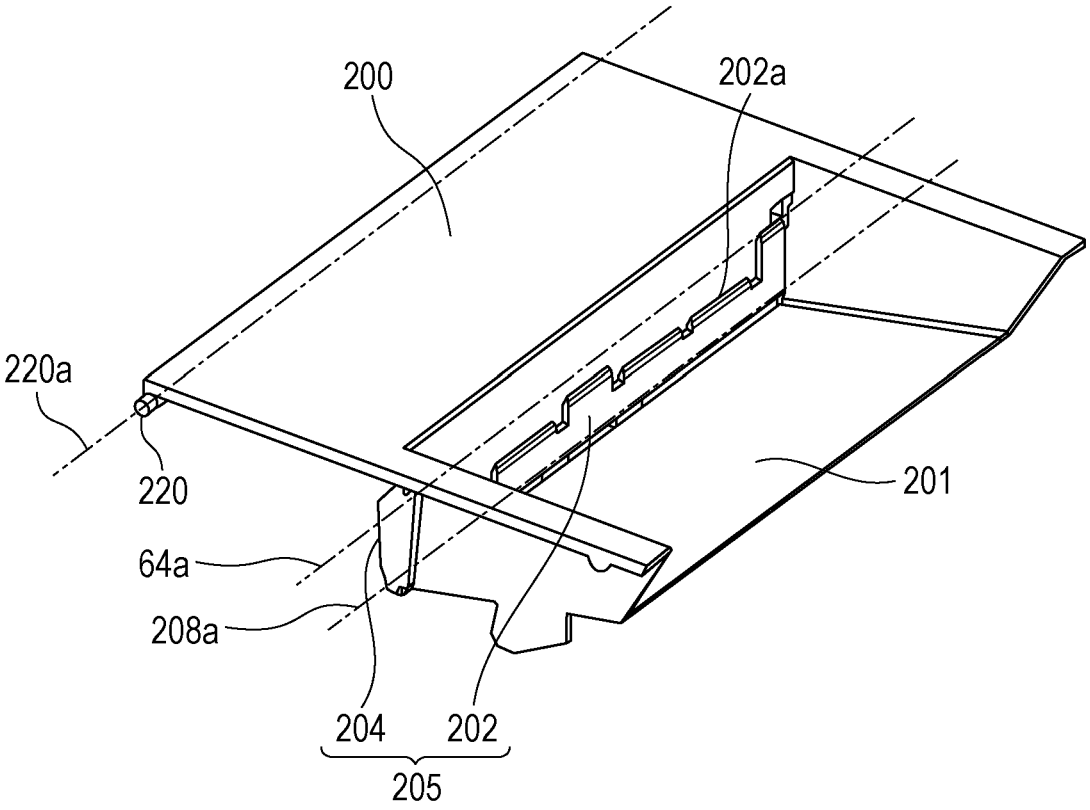
FIG. 13 is a perspective view of an opening and closing member according to a second embodiment.
Figure 14:
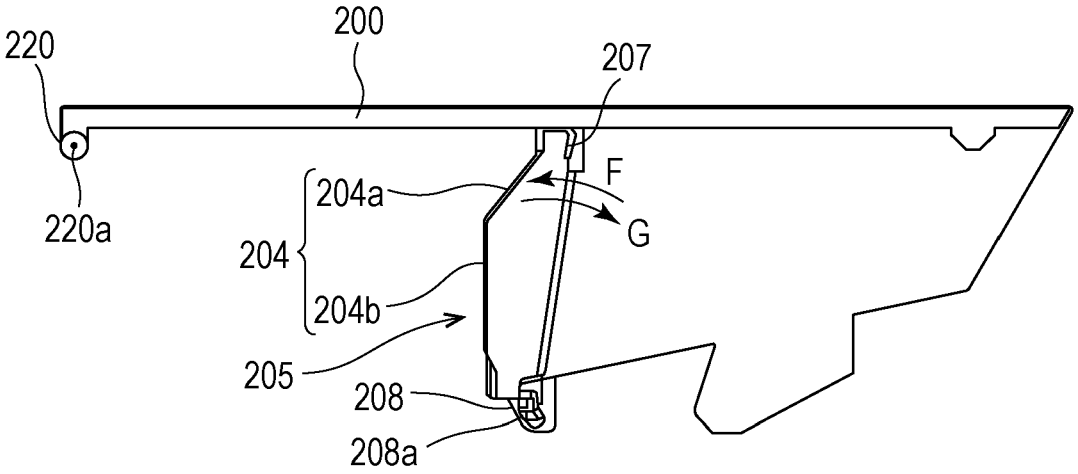
FIG. 14 illustrates the opening and closing member and a regulating member according to the second embodiment, as viewed from the direction of a rotational axis of the discharging roller.

An image forming apparatus 100 according to a second embodiment will now be described with reference to FIGS. 13, 14, 15A, 15B, 16A, 16B, 17A, 17B, 18A, and 18B. Descriptions of components identical to those in the first embodiment will be omitted. FIG. 13 is a perspective view of an opening and closing member 200. FIG. 14 illustrates the opening and closing member 200, as viewed from the direction of the second rotational axis 64*a* of the discharging roller 64.

The opening and closing member 200 has a stacking surface 201 and a supported portion 220. The supported portion 220 is supported so that the opening and closing member 200 is rotatable around a first rotational axis 220*a* relative to the frame 222 (see FIG. 2). The direction of the first rotational axis 220*a* is the direction extending along the second rotational axis 64*a* of the discharging roller 64. The opening and closing member 200 is configured to be rotatable around the first rotational axis 220*a* between a closed position in which the opening and closing member 200 covers the opening portion 900 shown in FIG. 1 and an open position in which the opening and closing member 200 exposes the opening portion 900.

The second embodiment differs from the first embodiment with respect to the following points. In contrast to the first embodiment in which the regulating wall 7 is fixed to the opening and closing member 90, a regulating member (regulating wall) 205 corresponding to the regulating wall 7 in the first embodiment is provided in a pivotable manner relative to the opening and closing member 200 in the second embodiment. The regulating member 205 has a pivotable supporter 208 supported by the opening and closing member 200 in a pivotable manner around a pivot axis 208*a* relative to the opening and closing member 200. The pivot axis 208*a* extends along the first rotational axis 220*a*. The regulating member 205 has a regulating surface (regulating wall) 202 that regulates the trailing edge of a sheet S stacked on the stacking surface 201, and also has cam surfaces 204 at opposite end portions located outside the regulating surface 202 in the direction of the pivot axis 208*a*. The end portion of the regulating surface 202 at the far side from the stacking surface 201 in the direction intersecting the stacking surface 201 is defined as an end portion 202*a*.

Figure 15A:
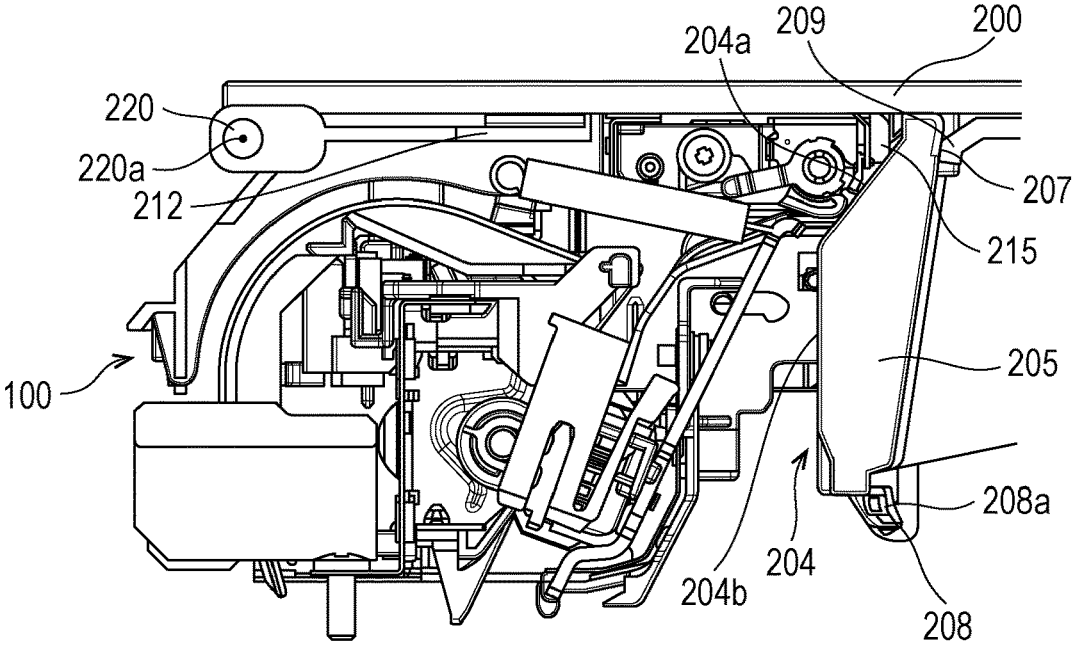
FIG. 15A is a cross-sectional view of a position in which a cam surface near the discharging roller is located when the opening and closing member is located in the closed position, in accordance with the second embodiment.

As shown in FIG. 14, the regulating member 205 is provided with the pivotable supporter 208 at the end portion on the side of the stacking surface 201 of the regulating member 205 in the direction intersecting the stacking surface 201, and is also provided with a stopper 207 at the end portion of the regulating member 205 on the opposite side from the pivotable supporter 208. The stopper 207 is provided for regulating pivoting of the regulating member 205 in the direction of an arrow G. Specifically, the stopper 207 has the following function when the opening and closing member 200 is located in the closed position. When the regulating member 205 tends to pivot in the direction in which the distance between the end portion 202*a* of the regulating surface 202 and the supported portion 220 (i.e., the first rotational axis 220*a*) of the opening and closing member 200 increases, the stopper 207 restricts pivoting of the regulating member 205 by contacting an abutment section 209 (FIG. 15A). The stopper 207 is provided at an end portion in the direction of the pivot axis 208*a*. Alternatively, a biasing member (not shown) that biases the regulating member 205 in the direction of an arrow F may be provided in place of the stopper 207.

The cam surfaces 204 face the frame 222 (see FIG. 2) and each have a first region 204*a* and a second region 204*b*. The second region 204*b* of each cam surface 204 is positionally closer to the first rotational axis 220*a* than the first region 204*a*, and is provided upstream of the first region 204*a* in the direction in which the opening and closing member 200 rotates from the closed position toward the open position. The first region 204*a* of the cam surface 204 is configured so that the distance to the first rotational axis 220*a* decreases toward the upstream side in the direction in which the opening and closing member 200 rotates from the closed position toward the open position.

Next, the position of the regulating member 205 when the opening and closing member 200 is rotated will be described with reference to FIGS. 15A, 15B, 16A, 16B, 17A, 17B, 18A, and 18B.

Figure 15B:
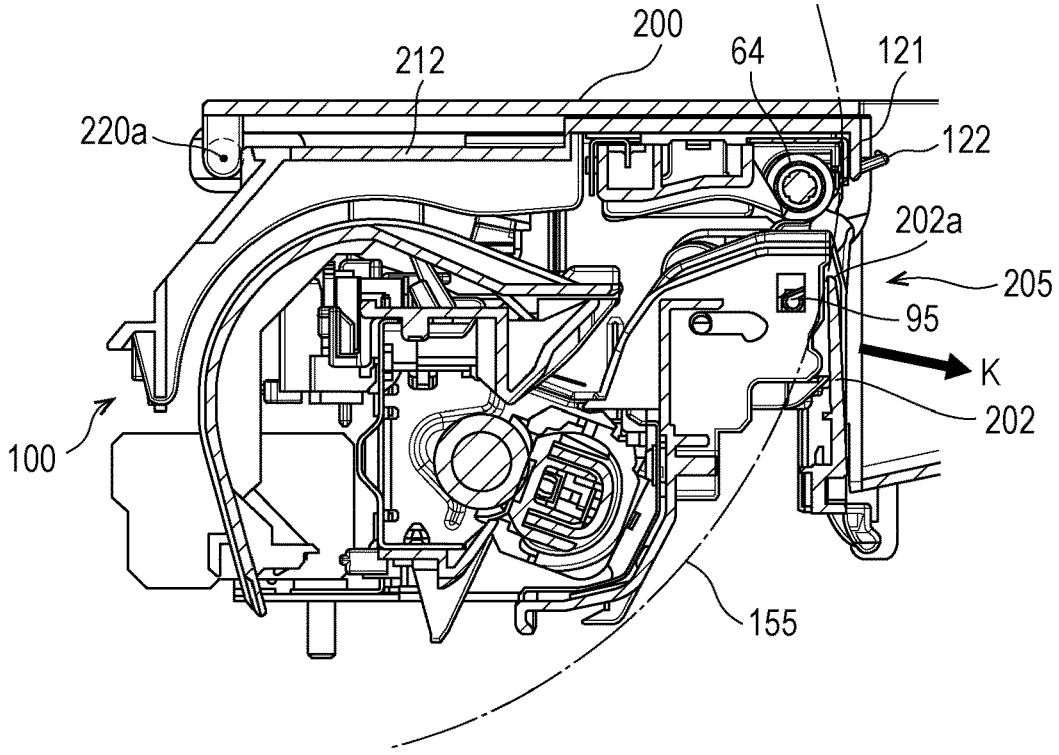
FIG. 15B is a cross-sectional view of a position in which a regulating wall near the discharging roller is located when the opening and closing member is located in the closed position, in accordance with the second embodiment.

FIGS. 15A and 15B are enlarged cross-sectional views of the discharging roller 64 and the vicinity thereof in the image forming apparatus 100 when the opening and closing member 200 is located in the closed position, taken in a direction orthogonal to the first rotational axis 220*a*. Specifically, FIG. 15A is a cross-sectional view of the image forming apparatus 100 in a region in which a cam surface 204 is located with respect to the direction of the first rotational axis 220*a*, and FIG. 15B is a cross-sectional view of the image forming apparatus 100 in a region in which the regulating surface 202 is located with respect to the direction of the first rotational axis 220*a*.

As shown in FIG. 15A, the first region 204*a* of the cam surface 204 is in contact with a contact portion 215. The stopper 207 is in abutment with (i.e., engaged with) the abutment section 209 provided in an inner cover 212. The regulating member 205 is interposed between the contact portion 215 and the abutment section 209, so that pivoting of the regulating member 205 in any direction around the pivot axis 208*a* is restricted.

During an image forming process, movement of a discharging guide 95 shown in FIG. 15B is regulated in the direction of an arrow K by the regulating member 205. When the opening and closing member 200 is located in the closed position, the regulating member 205 is prevented from rotating relative to the opening and closing member 200, thereby preventing a user from accessing the fixing unit 63 located within the regulating member 205.

A dashed line 155 serving as an imaginary circle that is centered on the first rotational axis 220*a* and in which the distance between the first rotational axis 220*a* and the end portion 202*a* of the regulating surface 202 is defined as the radius is located within the outer cover 121 and the protrusion 122.

Figure 16A:
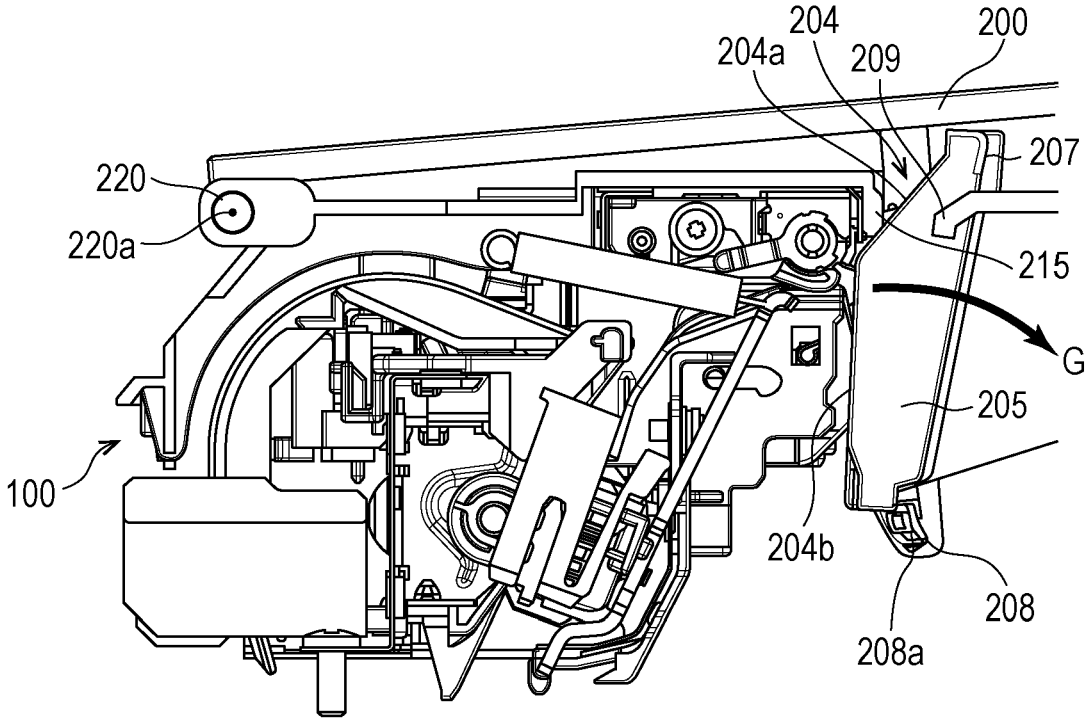
FIG. 16A is a cross-sectional view of the position in which the cam surface near the discharging roller is located when the opening and closing member has rotated by 5 degrees from the closed position to the open position, in accordance with the second embodiment.
Figure 16B:
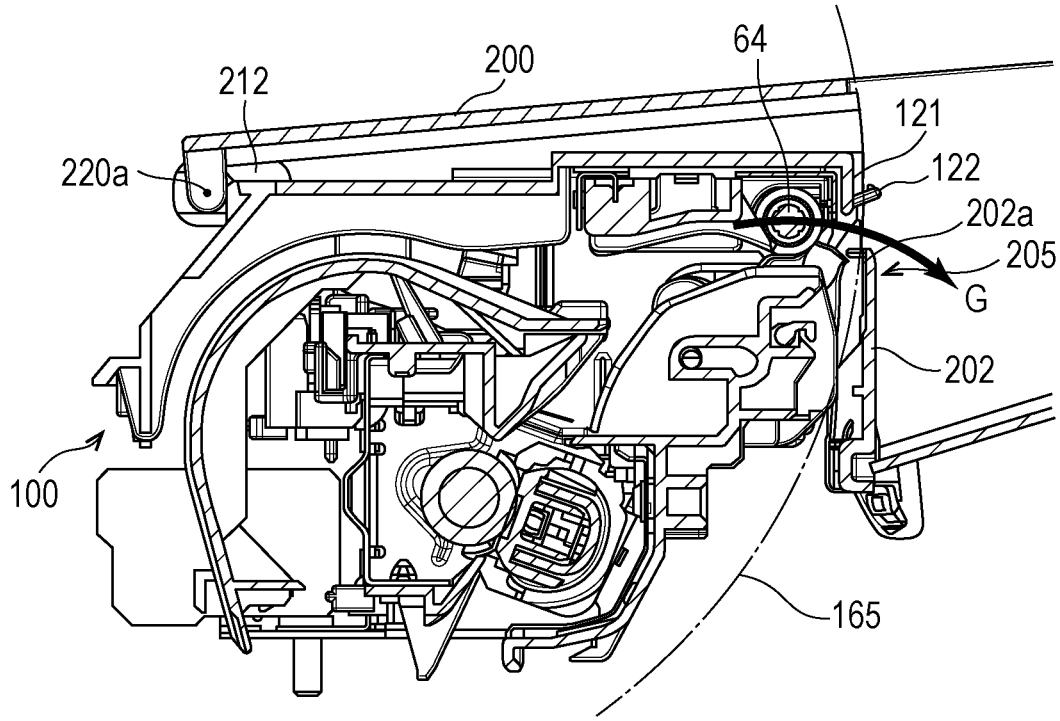
FIG. 16B is a cross-sectional view of the position in which the regulating wall near the discharging roller is located when the opening and closing member has rotated by 5 degrees from the closed position to the open position, in accordance with the second embodiment.

FIGS. 16A and 16B are cross-sectional views when the opening and closing member 200 has rotated by 5 degrees around the first rotational axis 220*a* from the closed position to the open position. Specifically, FIG. 16A is a cross-sectional view of the image forming apparatus 100 in the region in which a cam surface 204 is located with respect to the direction of the first rotational axis 220*a*, and FIG. 16B is a cross-sectional view of the image forming apparatus 100 in the region in which the regulating surface 202 is located with respect to the direction of the first rotational axis 220*a*.

While the opening and closing member 200 rotates by 5 degrees from the closed position, the stopper 207 and the abutment section 209 disengage from each other, and the regulating member 205 is pressed by the contact portion 215 and thus rotates around the pivot axis 208*a* in the direction of the arrow G. As shown in FIG. 16A, the regulating member 205 rotates while the first region 204*a* of the cam surface 204 and the contact portion 215 are in contact with each other. In this case, a dashed line 165 serving as an imaginary circle that is centered on the first rotational axis 220*a* and in which the distance between the first rotational axis 220*a* and an end portion 202*a* of the regulating surface 202 is defined as the radius is located within the outer cover 121 and the protrusion 122.

Figure 17A:
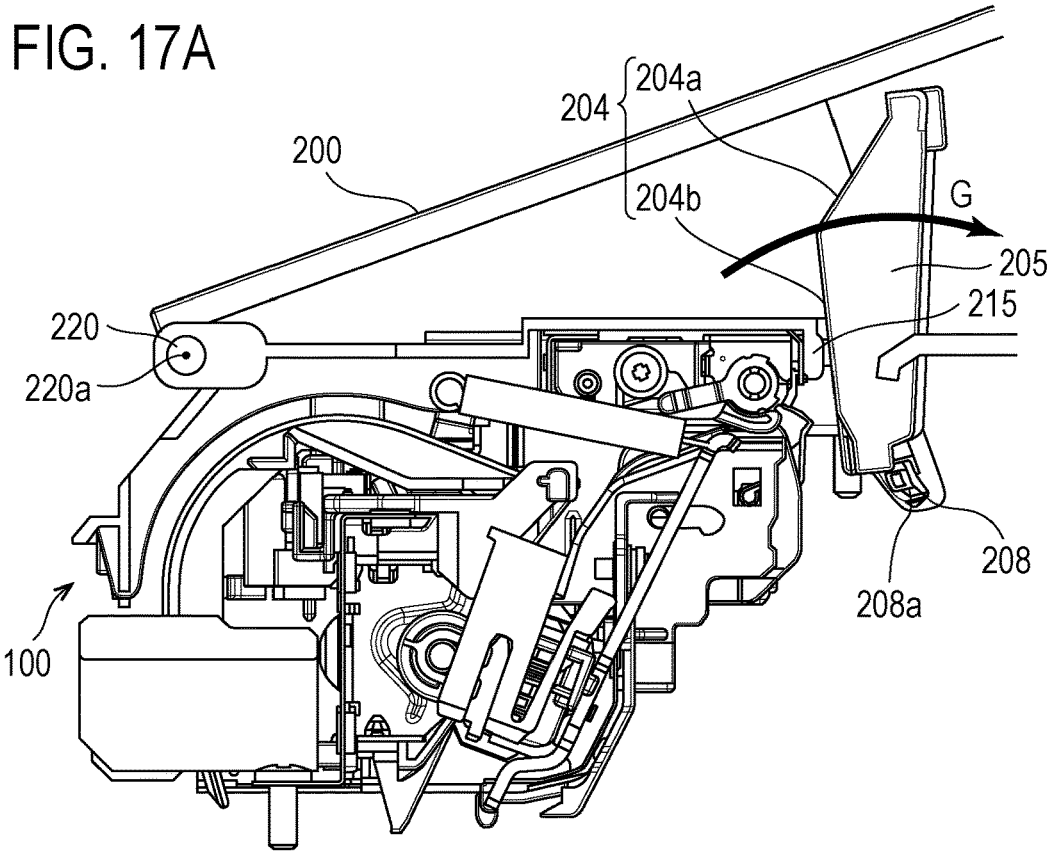
FIG. 17A is a cross-sectional view of the position in which the cam surface near the discharging roller is located when the opening and closing member has rotated by 20 degrees from the closed position to the open position, in accordance with the second embodiment.
Figure 17B:
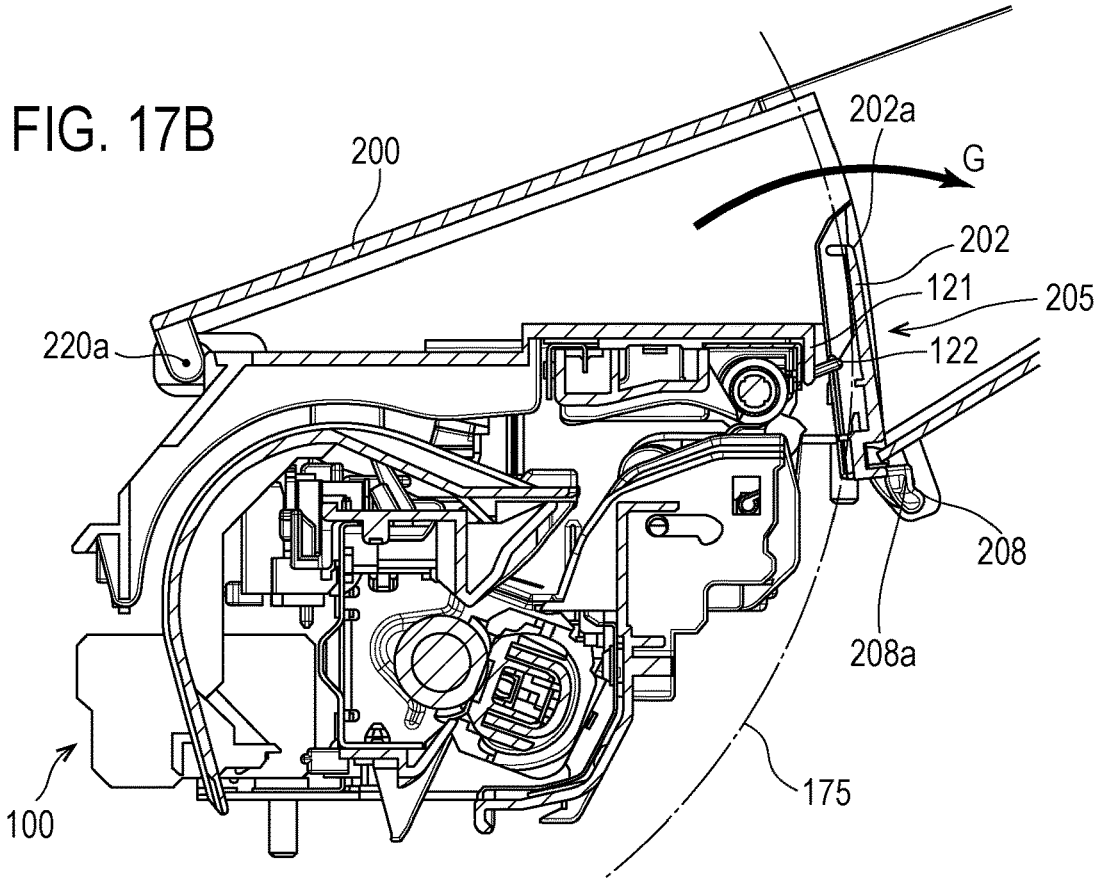
FIG. 17B is a cross-sectional view of the position in which the regulating wall near the discharging roller is located when the opening and closing member has rotated by 20 degrees from the closed position to the open position, in accordance with the second embodiment.

FIGS. 17A and 17B are cross-sectional views when the opening and closing member 200 has rotated by 20 degrees around the first rotational axis 220*a* from the closed position to the open position. Specifically, FIG. 17A is a cross-sectional view of the image forming apparatus 100 in the region in which a cam surface 204 is located with respect to the direction of the first rotational axis 220*a*, and FIG. 17B is a cross-sectional view of the image forming apparatus 100 in the region in which the regulating surface 202 is located with respect to the direction of the first rotational axis 220*a*. As shown in FIG. 17A, the second region 204*b* of the cam surface 204 is in contact with the contact portion 215. While the opening and closing member 200 rotates from the 5-degree position to the 20-degree position, the region coming into contact with the contact portion 215 changes from the first region 204*a* to the second region 204*b*, so that the regulating member 205 is pressed by the contact portion 215 and rotates around the pivot axis 208*a* in the direction of the arrow G. In this case, a dashed line 175 serving as an imaginary circle that is centered on the first rotational axis 220*a* and in which the distance between the first rotational axis 220*a* and the end portion 202*a* of the regulating surface 202 is defined as the radius is located outside the outer cover 121 and the protrusion 122. Specifically, the regulating member 205 pivots relative to the opening and closing member 200, so that the end portion 202*a* of the regulating surface 202 of the regulating member 205 can cause the opening and closing member 200 to rotate without interfering with the outer cover 121 and the protrusion 122.

Figure 18A:
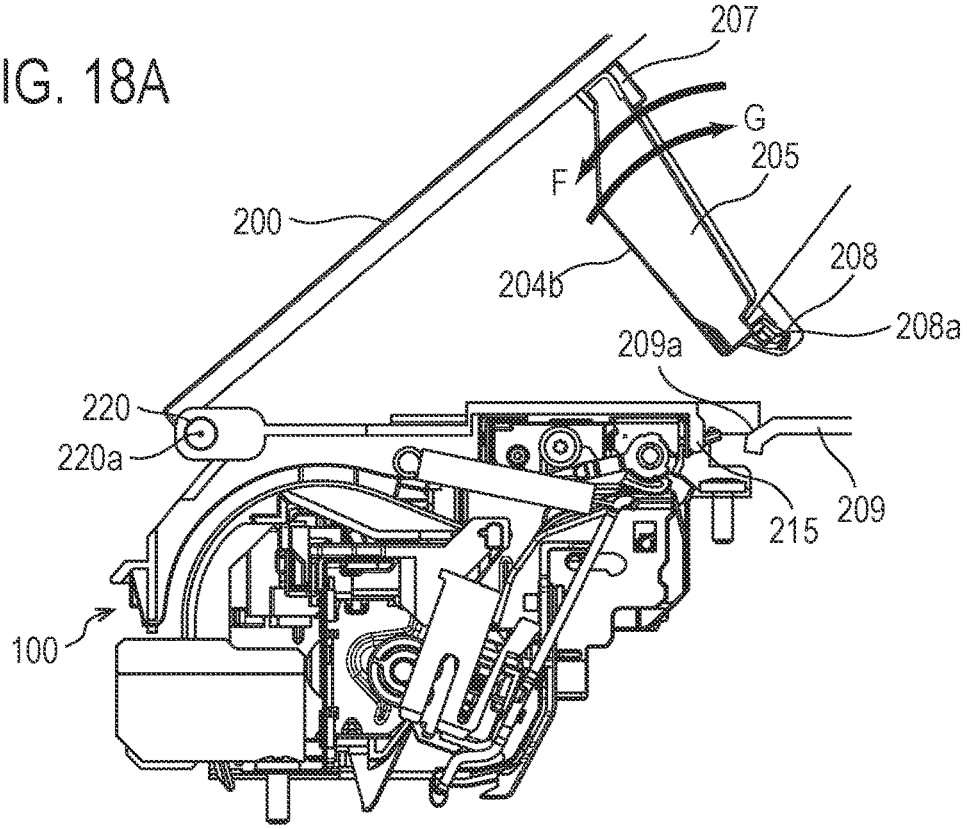
FIG. 18A is a cross-sectional view of the position in which the cam surface near the discharging roller is located when the opening and closing member has rotated by 40 degrees from the closed position to the open position, in accordance with the second embodiment.
Figure 18B:
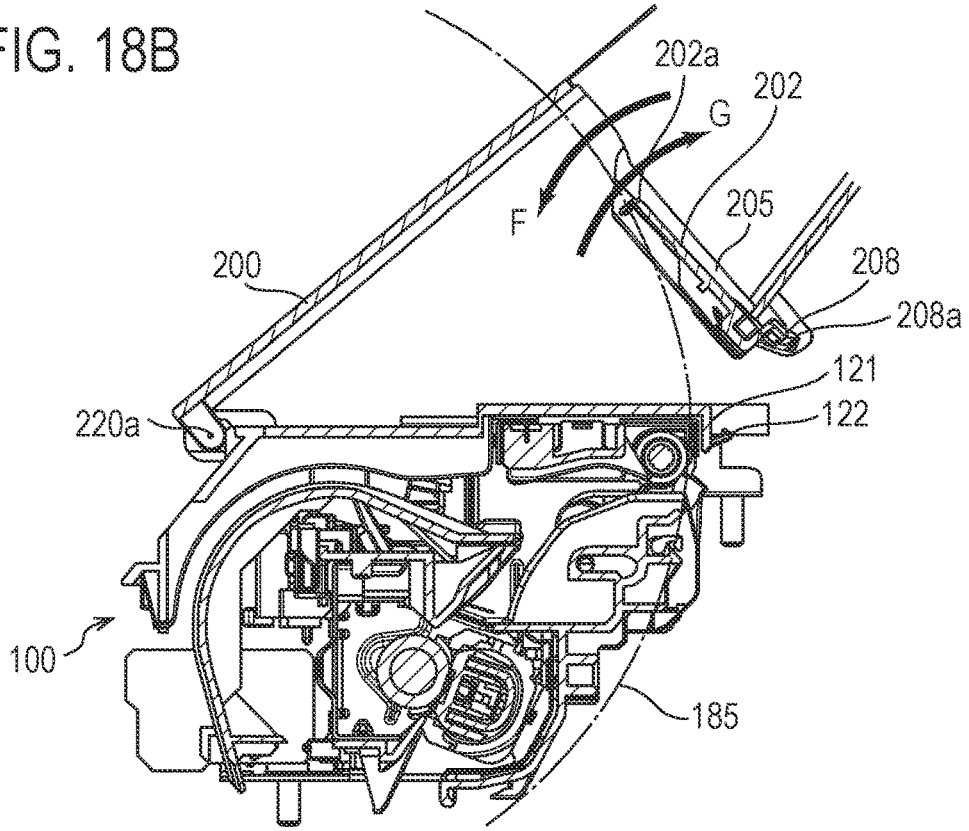
FIG. 18B is a cross-sectional view of the position in which the regulating wall near the discharging roller is located when the opening and closing member has rotated by 40 degrees from the closed position to the open position, in accordance with the second embodiment.

FIGS. 18A and 18B are cross-sectional views when the opening and closing member 200 has rotated by 40 degrees around the first rotational axis 220*a* from the closed position to the open position. Specifically, FIG. 18A is a cross-sectional view of the image forming apparatus 100 in the region in which a cam surface 204 is located with respect to the direction of the first rotational axis 220*a*, and FIG. 18B is a cross-sectional view of the image forming apparatus 100 in the region in which the regulating surface 202 is located with respect to the direction of the first rotational axis 220*a*. As shown in FIG. 18A, the opening and closing member 200 has rotated to a position in which the second region 204*b* of the cam surface 204 has passed the contact portion 215. Thus, the regulating member 205 rotates around the pivot axis 208*a* in the direction of the arrow F due to its own weight. In this case, a dashed line 185 serving as an imaginary circle that is centered on the first rotational axis 220*a* and in which the distance between the first rotational axis 220*a* and the end portion 202*a* of the regulating surface 202 is defined as the radius is located within the outer cover 121 and the protrusion 122. Specifically, assuming that the opening and closing member 200 rotates from this position toward the closed position without the regulating member 205 pivoting in the direction of the arrow G, the end portion 202*a* of the regulating surface 202 would interfere with the outer cover 121 and the protrusion 122 shown in FIG. 18B. In this configuration, when the opening and closing member 200 rotates from this position toward the closed position, the regulating member 205 rotates in the direction of the arrow G as a result of the stopper 207 coming into contact with a tapered section 209*a* of the abutment section 209. As a result, the opening and closing member 200 can move to the closed position shown in FIGS. 15A and 15B without the end portion 202*a* of the regulating surface 202 interfering with the outer cover 121 and the protrusion 122.

As described above, this embodiment can provide an image forming apparatus in which the opening and closing member can be opened and closed in a compact fashion without posing an impediment to the attachment and detachment processes of the cartridge and also without interfering with the apparatus main body. The term "interfere" used here has a meaning in which the opening and closing member comes into contact with a part of the apparatus main body other than the opening and closing member to an extent that the opening and closing member is not openable and closable, and does not include contact to an extent that the opening and closing member is openable and closable. Furthermore, without causing the supported portion 220 of the opening and closing member 200 to move, the opening and closing member 200 is openable and closable without interference in this embodiment, thereby achieving usability superior to that in the first embodiment. Moreover, because a rib 240 provided at the end portion on the side of the stacking surface 201 of the regulating surface 202 extends to a position below the stacking surface 201 in the gravitational direction, a gap is less likely be formed between the stacking surface 201 and the regulating surface 202. Therefore, even if there is a foreign object on the stacking surface 201, the foreign object is less likely to fall into the apparatus main body 2. Furthermore, the photosensitive drum 31 shown in FIG. 1 can be prevented from being exposed to light via the opening and closing member 200.

Figure 19:
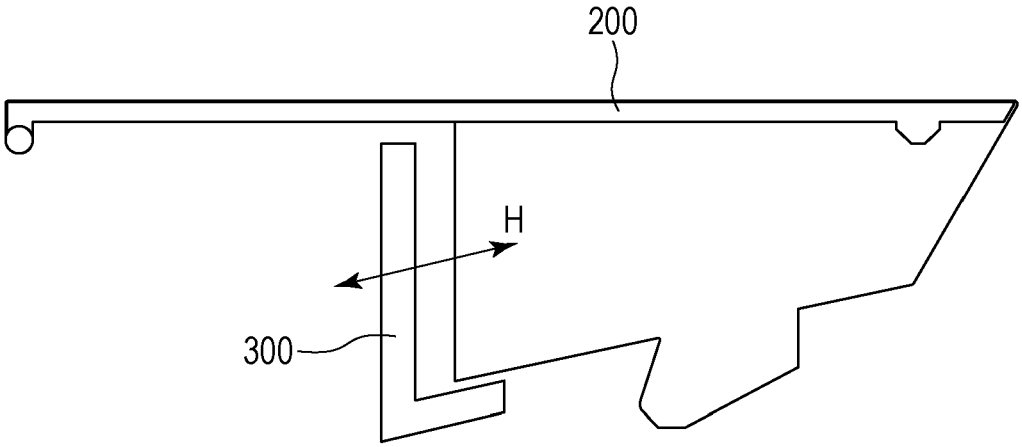
FIG. 19 is a cross-sectional view of an opening and closing member and a regulating wall according to a modification of the second embodiment.

In the above description, the regulating member 205 is configured to rotate to the opening and closing member 200. Alternatively, the regulating member 205 may cause a regulating wall 300 to move parallel to the opening and closing member 200 in the direction of an arrow H by using a cam (not shown) when the opening and closing member 200 opens, as shown in FIG. 19. Furthermore, as an alternative to this embodiment in which the regulating member moves as a result of the cam provided in the regulating member being pressed by the contact portion of the apparatus main body, the regulating member may be moved in conjunction with the opening-closing operation of the opening and closing member by using an electric actuator.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-120452, filed Jun. 27, 2019, which is hereby incorporated by reference herein in its entirety.

What is claimed is:

1. An image forming apparatus comprising:

a cartridge; and an apparatus main body to which the cartridge is detachably attached, the apparatus main body including:

a frame in which an opening portion, through which the cartridge is attached to the apparatus main body, is formed;

an opening and closing member configured to move between an open position in which the opening and closing member is opened to expose the opening portion and a closed position in which the opening and closing member is closed to cover the opening portion, the opening and closing member having a supported portion supported by the frame so that the opening and closing member is rotatable about a rotational axis, the opening and closing member having a stacking surface on which a sheet is to be stacked when the opening and closing member is located in the closed position;

a discharging roller configured to discharge the sheet in a discharging direction onto the stacking surface when the opening and closing member is located in the closed position; and a regulating wall configured to regulate a position of an upstream edge, in the discharging direction, of the sheet stacked on the stacking surface, the regulating wall extending from the stacking surface toward the discharging roller in an intersecting direction intersecting the discharging direction, the regulating wall being attached to the opening and closing member so as to be movable relative to the opening and closing member.

2. The image forming apparatus according to claim 1, wherein the regulating wall is attached to the opening and closing member so that the regulating wall pivots about a pivot axis relative to the opening and closing member, the pivot axis extending in a direction of the rotational axis and being disposed at an end portion of the regulating wall on a side of the stacking surface in the intersecting direction, and wherein, while the opening and closing member is rotated from the closed position toward the open position, the regulating wall is pivoted by contacting a part of the apparatus main body which is configured not to move together with the opening and closing member.

3. The image forming apparatus according to claim 2, wherein, when the end portion of the regulating wall is defined as a first end portion, the regulating wall has a second end portion opposite to the first end portion in the intersecting direction, and wherein the apparatus main body has a stopper configured to stop the regulating wall from pivoting around the pivot axis by contacting the second end portion of the regulating wall when the opening and closing member is located in the closed position.

4. The image forming apparatus according to claim 1, wherein the rotational axis is arranged upstream of the discharging roller in the discharging direction.

5. The image forming apparatus according to claim 1, wherein the regulating wall is attached to the opening and closing member so that the regulating wall pivots about a pivot axis relative to the opening and closing member, the pivot axis extending in a direction of the rotational axis and being disposed at an end portion of the regulating wall on a side of the stacking surface in the intersecting direction, and wherein the pivot axis of the regulating wall is arranged downstream of the rotational axis in the discharging direction.

6. An image forming apparatus comprising:

a cartridge; and an apparatus main body to which the cartridge is detachably attached, the apparatus main body including:

a frame in which an opening portion, through which the cartridge is attached to the apparatus main body, is formed;

a discharging roller configured to discharge a sheet in a discharging direction;

an opening and closing member configured to move between an open position in which the opening and closing member is opened to expose the opening portion and a closed position in which the opening and closing member is closed to cover the opening portion, the opening and closing member having a supported portion supported by the frame so that the opening and closing member is rotatable about a rotational axis, the opening and closing member having a stacking surface on which the sheet discharged by the discharging roller is to be stacked when the opening and closing member is located in the closed position, the supported portion being movable between a first position and a second position located downstream of the first position in the discharging direction, the supported portion being located in the first position when the opening and closing member is located in the closed position and being located in the second position when the opening and closing member is located in the open position; and a regulating wall configured to regulate a position of an upstream edge, in the discharging direction, of the sheet stacked on the stacking surface, the regulating wall extending from the stacking surface toward the discharging roller in an intersecting direction intersecting the discharging direction, the regulating wall being attached to the opening and closing member.

7. The image forming apparatus according to claim 6, wherein the opening and closing member includes a cam surface extending in the intersecting direction at an end portion of the opening and closing member in a direction of the rotational axis when the opening and closing member is located in the closed position, wherein the apparatus main body has a contact portion configured to contact the cam surface, and wherein, while the opening and closing member is rotated from the closed position toward the open position, the cam surface is pressed by the contact portion so that the supported portion is moved from the first position to the second position.

8. The image forming apparatus according to claim 7, wherein, when the opening and closing member is located in the closed position, the cam surface has a first region and a second region located upstream of the first region in a direction in which the opening and closing member is rotated from the closed position toward the open position, the second region being located in a position in which a distance from the rotational axis is shorter than that of the first region, and wherein, while the opening and closing member is rotated from the closed position toward the open position, the supported portion of the opening and closing member is located in the first position when the first region of the cam surface is in contact with the contact portion, and the supported portion of the opening and closing member is located in the second position when the second region of the cam surface is in contact with the contact portion.

9. The image forming apparatus according to claim 6, wherein the apparatus main body includes a biasing member configured to bias the opening and closing member relative to the frame in a direction in which the supported portion is moved from the second position toward the first position.

10. The image forming apparatus according to claim 6, wherein the opening and closing member has a regulated surface and a pressing portion configured to press the cartridge in a direction in which the cartridge is moved toward an image formation position, wherein the frame has a regulating surface configured to contact the regulated surface of the opening and closing member while the opening and closing member is rotated from the open position toward the closed position, and wherein the opening and closing member is configured so that, when the cartridge is pressed by the pressing portion, the regulated surface contacts the regulating surface of the frame to prevent the supported portion from moving from the first position toward the second position.

* * * * *